US012628925B2

(12) United States Patent
Verma

(10) Patent No.: US 12,628,925 B2
(45) Date of Patent: May 19, 2026

(54) ALL TERRAIN BACKPACK

(71) Applicant: Anand Kumar Verma, Madison, WI (US)

(72) Inventor: Anand Kumar Verma, Madison, WI (US)

( * ) Notice: Subject to any disclaimer, the term of this patent is extended or adjusted under 35 U.S.C. 154(b) by 145 days.

(21) Appl. No.: 17/984,896

(22) Filed: Nov. 10, 2022

(65) Prior Publication Data

US 2024/0049852 A1 Feb. 15, 2024

Related U.S. Application Data

(60) Provisional application No. 63/356,264, filed on Jun. 28, 2022, provisional application No. 63/278,929, filed on Nov. 12, 2021.

(51) Int. Cl.

| | |
|---|---|
| ***A45C 13/26*** | (2006.01) |
| ***A45C 5/14*** | (2006.01) |
| ***A45C 13/28*** | (2006.01) |
| ***A45F 3/04*** | (2006.01) |

(52) U.S. Cl.

CPC ..... *A45C 13/262* (2013.01); *A45C 5/14* (2013.01); *A45C 13/28* (2013.01); *A45F 3/04* (2013.01); *A45C 2013/267* (2013.01)

(58) Field of Classification Search

CPC . A45C 13/262; A45C 13/28; A45C 2013/267; A45C 5/14; A45F 3/04

See application file for complete search history.

(56) References Cited

U.S. PATENT DOCUMENTS 3,620,428 A * 11/1971 Silverthorne ..... A45F 3/08 224/156
3,881,644 A * 5/1975 Demaline ..... A45F 3/10 224/161
4,286,739 A * 9/1981 Silcott ..... A45F 4/02 224/155
4,885,812 A * 12/1989 Lindner ..... A47C 17/82 5/112
5,374,073 A * 12/1994 Hung-Hsin ..... A45C 9/00 280/30
5,460,307 A * 10/1995 Stevenson ..... A45F 4/02 280/30
5,588,569 A * 12/1996 Mitomi ..... A45C 5/14 190/110
5,921,635 A * 7/1999 Deliman ..... B60B 33/0028 301/132
6,550,651 B1 * 4/2003 Murdoch ..... A45C 13/262 224/580

(Continued)

OTHER PUBLICATIONS

Logo Brands, Rolling Cooler with Wheels and Backpack Straps, amazon.ca/Chicago-48-Can-Rolling-Cooler-Backpack/dp/B00V87ENCK.

Jansport, Scout Outdoor Backpack, amazon.com/Jansport-Scout-Outdoor-Backpack-Forge/dp/B0047FSV8M/ref=cm_cr_arp_d_product_top?ie=UTF8.

(Continued)

*Primary Examiner* — Nathan J Jenness

*Assistant Examiner* — Justin Caudill

(74) *Attorney, Agent, or Firm* — Boardman & Clark LLP

(57) ABSTRACT

A wheeled backpack includes a telescoping handle assembly, an axle coupled to the telescoping handle assembly, wheels having an inner side, the wheels being rotatably coupled to each end of the axle, and the axle and the telescoping handle assembly coupled to a lower portion of a backpack provided at least mostly between the inner sides of the wheels.

20 Claims, 21 Drawing Sheets

(56) References Cited

U.S. PATENT DOCUMENTS

| | | | | |
|---|---|---|---|---|
| 7,617,956 | B1 * | 11/2009 | Sabbah | A45C 5/143 280/37 |
| 8,496,344 | B1 * | 7/2013 | Chapman | A45C 15/06 362/108 |
| 8,613,349 | B1 * | 12/2013 | Halko | A45C 9/00 280/37 |
| 8,955,656 | B1 * | 2/2015 | Foster | A45C 5/03 108/17 |
| 10,206,469 | B2 * | 2/2019 | Pickavance | B62K 3/002 |
| 10,561,234 | B1 * | 2/2020 | von Goins | A47B 23/06 |
| 10,647,340 | B2 * | 5/2020 | Kinnee | B62K 27/003 |
| 2004/0195791 | A1 * | 10/2004 | Brookes-Inglis | A45F 3/04 280/47.26 |
| 2005/0103589 | A1 * | 5/2005 | Russo | A45F 4/02 190/18 A |
| 2007/0164064 | A1 * | 7/2007 | Nathan | A45F 3/04 224/153 |
| 2008/0223679 | A1 * | 9/2008 | Wong | A45C 13/385 190/18 A |
| 2013/0032443 | A1 * | 2/2013 | Soedomo | A45C 9/00 190/11 |
| 2013/0153351 | A1 * | 6/2013 | House, III | A45C 13/28 190/11 |
| 2015/0272291 | A1 * | 10/2015 | Sener | A45C 13/262 190/18 A |
| 2016/0022032 | A1 * | 1/2016 | Simon | A45C 13/28 108/42 |
| 2016/0037905 | A1 * | 2/2016 | Glover | A47B 3/12 108/42 |
| 2018/0215198 | A1 * | 8/2018 | Winfield | A45C 13/38 |
| 2018/0271310 | A1 * | 9/2018 | Klugh | A47G 23/0225 |
| 2019/0150596 | A1 * | 5/2019 | Cummings | A45C 5/14 |
| 2021/0076791 | A1 * | 3/2021 | DeVeaux | A45C 13/262 |

OTHER PUBLICATIONS

King's Guard, Woodland Camo 70L Camping Hiking Military Tactical Backpack Outdoor Water-Repellent Adjustable Sports Bags, amazon.com/Military-Tactical-Backpack-Water-Repellent-Adjustable/dp/B08QCQRG23?source=ps-sl-shoppingads-lpcontext&ref_=fplfs&smid=AP6UX9KUTPGRC&th=1.

High Sierra, Wheeled Backpack/Daypack, shop.highsierra.com/backpacks/wheeled/.

Uniker, Universal Wheel Trolley Bag, uniker.com/trolley-bag.

Osprey, Wheeled Luggage Duffel Sojourn, osprey.com/travel/luggage/wheeled-luggage.

J World, Lollipop Kids Rolling Backpack, jworldstore.com/products/lollipop-kids-rolling-backpack-with-lunch-bag-16-inch?variant=22226663309391.

YH&GS, Rolling, Waterproof Backpack with Wheels for Business, College Student and Travel Commuter, Carry on Backpack with Laptop Compartment, Fit 17 Inch Laptop, Wheeled Backpack for Adults, amazon.com/Backpack-Waterproof-Business-Commuter-Compartment/dp/B092VQ2P3L?th=1.

G-RO, Luggage and backpacks with charing capabilites, unrivaled durability, ergonomic design, and wheels that let you roll over everything, kickstarter.com/projects/netta/g-ro-companion-office-backpacks-and-check-in-bags.

Zuca, All-Terrain Cart, zuca.com/collections/disc-golf?gclid=Cj0KCQiA1rSsBhDHARIsANB4EJZOxGMivojGZ2X8aWvbV66yqF9P1AFJulFZbM6Hu0nmUVJVwLwFskYaAqKmEALw_wcB.

Zuca and Dynamic Discs, Disc Golf Carts by Zuca, dynamicdiscs.com/collections/disc-golf-carts.

MVP Disc Sports, Rover Disc Golf Cart, mvpdiscsports.com/products/bags/rover-cart/.

Veto Pro Pac, Tech Pac Wheeler, vetopropac.com/tech-pac-wheeler/.

Ridge Roller Customs, New V3 Roller, ridgeroller.com/products/.

* cited by examiner

ALL TERRAIN BACKPACK

CROSS-REFERENCE TO RELATED APPLICATIONS

This application claims the benefit of United States Provisional Patent Application Nos. 63/278,929, filed on Nov. 12, 2021, entitled "ALL TERRAIN BACKPACK," and 63/356,264, filed on Jun. 28, 2022, the entire content of each of which is hereby incorporated by reference herein in its entirety.

FIELD

The present inventions relate to the field of backpacks. The present inventions more specifically relate to the field of all terrain backpacks (e.g., wheeled backpacks).

BACKGROUND

A known type of luggage or bag is a rolling or wheeled luggage or bag. However, such bags tend to be unstable, especially when packed. They are unstable at rest and tend to tip unless they are leaned against a more stable surface. They are also unstable and can be cumbersome, tedious or difficult to control when in motion. Further, the wheels tend to be small in diameter which makes them difficult to use on an unsmooth or uneven surfaces (e.g., pavement, grass, gravel, snow, etc.) and at times challenging to take up or down stairs.

Known rolling or wheeled luggage, bags or backpacks tend to utilize a telescoping handle for ease of wheeling the luggage, bag or backpack. However, these handles are typically if ever configured for other uses. Notably, such handles tend to be unstable themselves. For example, they regularly collapse unexpectedly, can be difficult to extend as desired, etc.

In some activities (e.g., disc golf), it is known to use backpacks for carrying contents (e.g., discs and other equipment). Such backpacks (e.g., with water bottles, disc golf discs and equipment) tend to be heavy but work well in hilly, uneven and/or rugged terrain.

Because such backpacks and contents can be heavy or cumbersome, in some activities (e.g., disc golf) it is also known to use separate wheeled carts. Disc golf backpacks can be set in or otherwise coupled to such carts to allow the backpacks and contents to be rolled. Such backpacks (e.g., with water bottles, disc golf discs and equipment) can be more easily transported in carts, provided the terrain is more relatively even and smooth. However, the carts do not work well on some terrain (e.g., hilly and/or rocky terrain) and the backpacks will be removed from the cart and the two will be carried separately.

In addition, known carts are bulky and also tend to be heavy and cumbersome to try to carry, especially with backpacks or contents set or coupled to them. Known cart and backpack combinations are not designed or adapted to be carried on a back like a backpack. In addition, while it would be convenient in many situations to do so, it can be unsafe and/or uncomfortable to sit on known luggage or use it as a seat.

In addition, known backpacks, bags and luggage lack many features that would be useful to the user.

SUMMARY

There is a need for improved luggage, bags, coolers (e.g., insulated or thermal bags), and backpacks and, more particularly, wheeled luggage, bags and backpacks.

There is also a need for luggage, bags, coolers, and backpacks with improved stability, and luggage, bags and backpacks that can better handle and roll easier on less than ideal or a variety of terrain.

There is also a need for improved lighter weight, rollable and easier to carry backpack-style disc golf bags.

There is also a need for improved lighter weight, rollable and easier to carry backpack-style hiking or camping bags.

There is also a need for a wheeled backpack, bag, cooler, or luggage with improved independent suspension and steering.

There is also a need for a backpack, bag, cooler, or luggage that is stable and designed or adaptable to be used as a seat.

There is a need for a wheeled backpack, bag, cooler, or luggage with a telescoping handle that with an improved locking apparatus to prevent the telescope handle from slipping or collapsing.

There is also a need for a rolling backpack, bag, cooler, or luggage with a telescoping handle with additional functionality.

There is a need for a wheeled backpack, bag, cooler, or luggage that functions as a camera dolly.

There is also a need for a wheeled backpack, bag, cooler, or luggage that is convertible into or otherwise useable as hand truck or a hauling and loading dolly (e.g., two wheel dolly).

There is also a need for a wheeled backpack, bag, cooler, or luggage that can carry longer items such as an umbrella, golf clubs, a shovel or tripod.

There is a need for a wheeled backpack, bag, cooler, or luggage with an umbrella holder.

There is also a need for a wheeled backpack, bag, cooler, or luggage with a flashlight holder.

There is also a need for a wheeled backpack, bag, cooler, or luggage with a multi-light (e.g., LED) system including a red flashing emergency, low beam, and/or high spotlight flashlight.

There is also a need for a wheeled backpack, bag, cooler, or luggage with the front light and/or a rear light with safety features (e.g., a flashing and strobe and/or flashing and chasing mode for safety on the road trails and highways).

There is also a need for a wheeled backpack, bag, cooler, or luggage with a detachable rotatable headlight.

There is a need for a wheeled backpack, bag, cooler, or luggage with a built-in headlamp which can be removed and used normally over the head once attached to a strap or headband.

There is a need for a wheeled backpack, bag, cooler, or luggage that has a camera mount coupled (e.g., slidably or releasably coupled) to the telescoping handle.

There is a need for a wheeled backpack, bag, cooler, or luggage with a camera mount (e.g., an iPhone, GoPro, and/or D SLR mount).

There is a need for a wheeled backpack, bag, cooler, or luggage with a dog leash holder attachment.

There is a need for a wheeled backpack, bag, cooler, or luggage made from waterproof PVC material or fabric.

There is a need for a wheel backpack, bag, cooler, or luggage with a built-in water bag (e.g., a hydration bladder, a two-liter leak proof water bladder, a water reservoir for a hydration pack, etc.).

There is a need for a wheel backpack, bag, cooler, or luggage with secret, hidden or protected wallet ID passport area that is difficult for thieves to access.

There is a need for a wheeled backpack, bag, cooler, or luggage with a built-in and/or readily accessible eating plate or utility plate.

There is a need for a wheeled backpack, bag, cooler, or luggage with multiple hooks (e.g., "D" hooks) for attaching items.

There is a need for a wheeled backpack, bag, cooler, or luggage with a duffel bag handle.

There is a need for a wheeled backpack, bag, cooler, or luggage with magnets or magnetic areas to help retain metal items.

There is a need for a wheeled backpack, bag, cooler, or luggage with a keychain lanyard attached (e.g., to safely and securely hold keys, IDs, etc.).

There is a need for a wheeled backpack, bag, cooler, or luggage with additional lumbar support and back support.

There is a need for a wheeled backpack, bag, cooler, or luggage with an improved adjustable sternum support strap.

There is a need for a wheel backpack, bag, cooler, or luggage with a built-in mini pillow storage that, when retaining a pillow, provides extra padding for back, spinal, and lumbar comfort.

There is a need for a wheel backpack, bag, cooler, or luggage with more external storage compartments (e.g., pockets, Hawk's pouches, etc.).

There is a need for a wheeled backpack, bag, cooler, or luggage with a built tripod head screw for GoPro or smart phone/tablet/camera.

There is a need for a wheeled backpack, bag, cooler, or luggage having a solar panel (or replaceable solar panel), which panel can be electrically coupled to a battery and/or charging port (e.g., a USB or other charging port) to use solar power to charge and/or power such devices.

There is a need for a wheeled backpack, bag, cooler or luggage with storage (e.g., a detachable or removable storage drawer) underneath the chassis, (e.g., that can also serve as a BBQ or other fireproof or resistant grill, bowl or plate).

There is a need for a wheeled backpack, bag, cooler, or luggage with a lock and cable for safety and theft prevention.

There is a need for a wheeled backpack, bag, cooler, or luggage with built-in stress reducer (e.g., fidget spinner).

There is a need for a wheeled backpack, bag, cooler or luggage with a utility tray (e.g., a collapsible or folding utility tray).

There is a need for a wheeled backpack that may be used as a walker or walking aid, or a vehicle (e.g., a gurney, stretcher, cart, buggy, rover, etc.)

There is a need to a wheeled backpack that may be carried or dropped (e.g., parachuted) into a military or combat operation and can provide gear and protection for soldiers in such operations.

Accordingly, a backpack, bag, cooler, or luggage that is light weight, rollable and easier to carry and/or transport is provided and disclosed herein.

In addition, an improved backpack, luggage, cooler, or bag is provided and disclosed herein.

In addition, a backpack, luggage, cooler, or bag with improved stability, and that can better handle and roll easier on less than ideal or a variety of terrain, is provided herein.

In addition, a backpack, luggage, cooler, or bag that is stable and designed or adaptable to be used as a seat is provided herein.

In addition, a wheeled backpack, bag, cooler, or luggage with improved independent suspension and steering is provided herein.

In addition, a backpack, bag, cooler, or luggage that is stable and designed or adaptable to be used as a seat is provided herein.

In addition, a wheeled backpack, bag, cooler, or luggage with a telescoping handle that with an improved locking apparatus to prevent the telescope handle from slipping or collapsing is provided herein.

In addition, a rolling backpack, bag, cooler, or luggage with a telescoping handle with additional functionality is provided herein.

In addition, a wheeled backpack, bag, cooler, or luggage that functions as a camera dolly is provided herein.

In addition, a wheeled backpack, bag, cooler, or luggage that is convertible into or otherwise useable as a hauling and loading dolly is provided herein.

In addition, a wheeled backpack, bag, cooler, or luggage that can carry longer items such as an umbrella or shovel or tripod is provided herein.

In addition, a wheeled backpack, bag, cooler, or luggage with an umbrella holder is provided herein.

In addition, a wheeled backpack, bag, cooler, or luggage with a flashlight holder is provided herein.

In addition, a wheeled backpack, bag, cooler, or luggage with a multi-light (e.g., LED) system including a red flashing emergency, low beam, and/or high spotlight flashlight is provided herein.

In addition, a wheeled backpack, bag, cooler, or luggage with the front light and/or a rear light with safety features (e.g., a flashing and strobe and/or flashing and chasing mode for safety on the road trails and highways) is provided herein.

In addition, a wheeled backpack, bag, cooler, or luggage with a detachable rotatable headlight is provided herein.

In addition, a wheeled backpack, bag, cooler, or luggage with a built-in headlamp which can be removed and used normally over the head once attached to a strap or headband is provided herein.

In addition, a wheeled backpack, bag, cooler, or luggage that has a camera mount coupled (e.g., slidably or releasably coupled) to the telescoping handle is provided herein.

In addition, a wheeled backpack, bag, cooler, or luggage with a camera mount (e.g., an iPhone, GoPro, and/or DSLR mount) is provided herein.

In addition, a wheeled backpack, bag, cooler, or luggage with a dog leash holder attachment is provided herein.

In addition, a wheeled backpack, bag, cooler, or luggage made from waterproof PVC material or fabric is provided herein.

In addition, a wheel backpack, bag, cooler, or luggage with a built-in water bag (e.g., a hydration bladder, a two-liter leak proof water bladder, a water reservoir for a hydration pack, etc.) is provided herein.

In addition, a wheel backpack, bag, cooler, or luggage with secret, hidden or protected wallet ID passport area that is difficult for thieves to access is provided herein.

In addition, a wheeled backpack, bag, cooler, or luggage with a built-in and/or readily accessible eating plate or utility plate is provided herein.

In addition, a wheeled backpack, bag, cooler, or luggage with multiple hooks (e.g., "D" hooks) for attaching items is provided herein.

In addition, a wheeled backpack, bag, cooler, or luggage with a duffel bag handle is provided herein.

In addition, a wheeled backpack, bag, cooler, or luggage with magnets or magnetic areas to help retain metal items is provided herein.

In addition, a wheeled backpack, bag, cooler, or luggage with a keychain lanyard attached (e.g., to safely and securely hold keys, IDs, etc.) is provided herein.

In addition, a wheeled backpack, bag, cooler, or luggage with additional lumbar support and back support is provided herein.

In addition, a wheeled backpack, bag, cooler, or luggage with an improved adjustable sternum support strap is provided herein.

In addition, a wheel backpack, bag, cooler, or luggage with a built-in mini pillow storage that, when retaining a pillow, provides extra padding for back, spinal, and lumbar comfort is provided herein.

In addition, a wheel backpack, bag, cooler, or luggage with more external storage (e.g., pockets, Hawk's pouches, etc.) is provided herein.

In addition, a wheeled backpack, bag, cooler, or luggage with a built tripod head screw for GoPro or smart phone/tablet/camera is provided herein.

In addition, a wheeled backpack, bag, cooler, or luggage having a solar panel (or replaceable solar panel), which panel can be electrically coupled to a battery and/or charging port (e.g., a USB or other charging port) to use solar power to charge and/or power such devices is provided herein.

In addition, a wheeled backpack, bag, cooler, or luggage with storage (e.g., a detachable or removable storage drawer) underneath the chassis, (e.g., that can also serve as a BBQ or other fireproof or resistant grill, bowl or plate) is provided herein.

In addition, a wheeled backpack, bag, cooler, or luggage with a lock and cable for safety and theft prevention is provided herein.

In addition, a wheeled backpack, bag, cooler, or luggage with built-in stress reducer (e.g., fidget spinner) is provided herein.

In addition, a wheeled backpack, bag, cooler or luggage with a utility tray (e.g., a collapsible or folding utility tray) is provided herein.

In addition, a wheeled backpack that may be used as a walker or walking aid, or a vehicle (e.g., a gurney, stretcher, cart, buggy, rover, etc.) is provided herein.

In addition, a wheeled backpack that may be carried or dropped (e.g., parachuted) into a military or combat operation and can provide gear and protection for soldiers in such operations is provided herein.

Accordingly, provided herein is a wheeled backpack comprising: a telescoping handle assembly having a series of concentric tubes, the series of concentric tubes having an upper portion and a lower portion; a handle coupled to the upper portion of the series of concentric tubes; an axle coupled the lower portion of the series of concentric tubes; wheels rotatably coupled to each end of the axle, the wheels each having an inner side and an outer side; and the axle and series of concentric tubes being coupled to a lower portion of a backpack provided at least mostly between the inner sides of the wheels.

Accordingly, provided herein is a wheeled backpack comprising: a telescoping handle assembly having a series of concentric tubes, the series of concentric tubes having an upper portion and a lower portion; a handle coupled to the upper portion of the series of concentric tubes; a first axle coupled the lower portion of the series of concentric tubes; wheels rotatably coupled to each end of the first axle, the wheels each having an inner side and an outer side; and the first axle and series of concentric tubes being coupled to a lower portion of a pack bag provided at least mostly between the inner sides of the wheels; and an external frame coupled to the pack bag, the external frame having an upper portion and a lower portion.

BRIEF DESCRIPTION OF DRAWINGS

Various examples of embodiments of the systems, devices, and methods according to this invention will be described in detail, with reference to the following figures, wherein.

Figure 1:
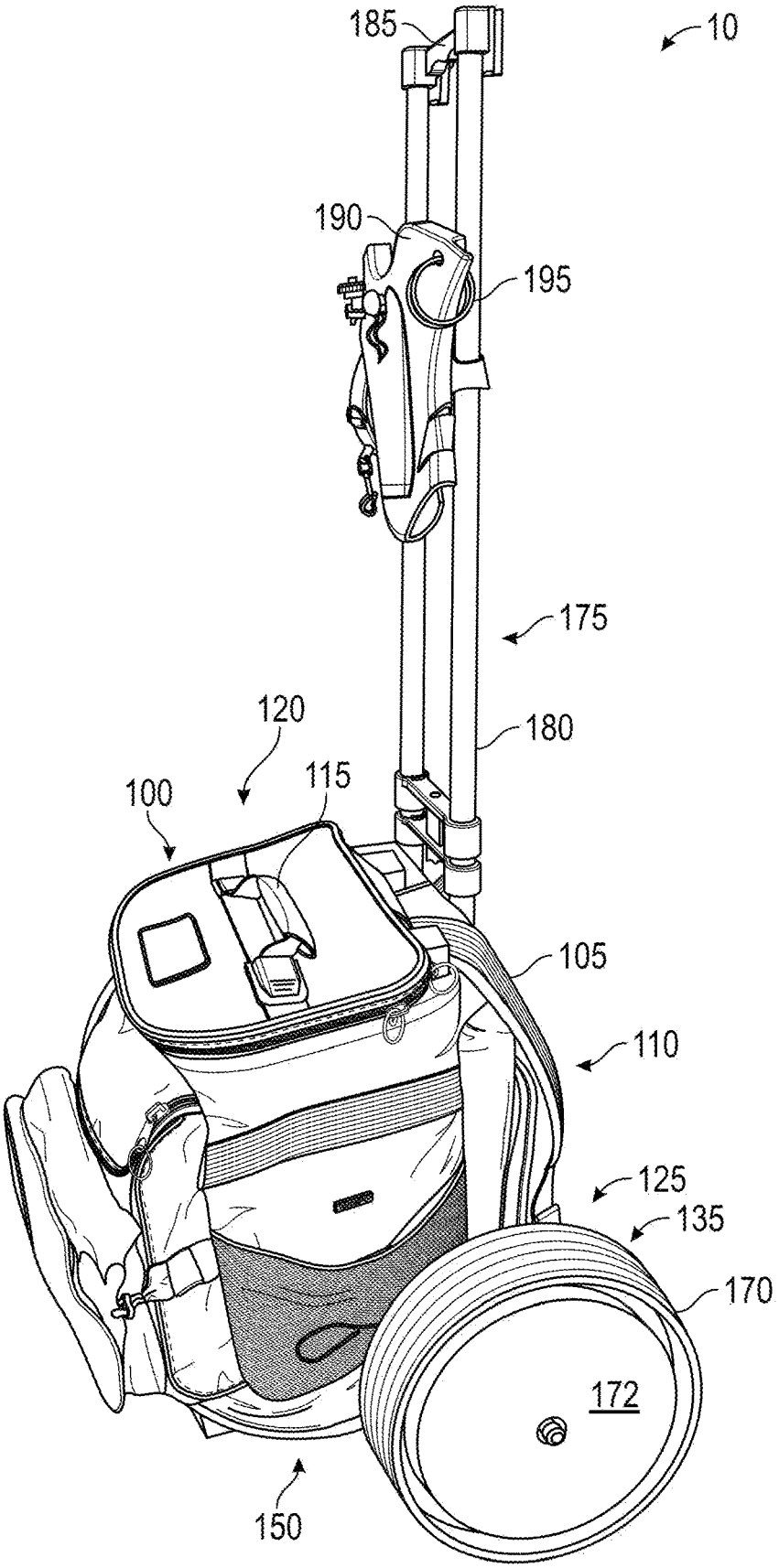
FIG. 1 illustrates a side perspective view of a wheeled backpack, according to various examples of embodiments.
Figure 2:
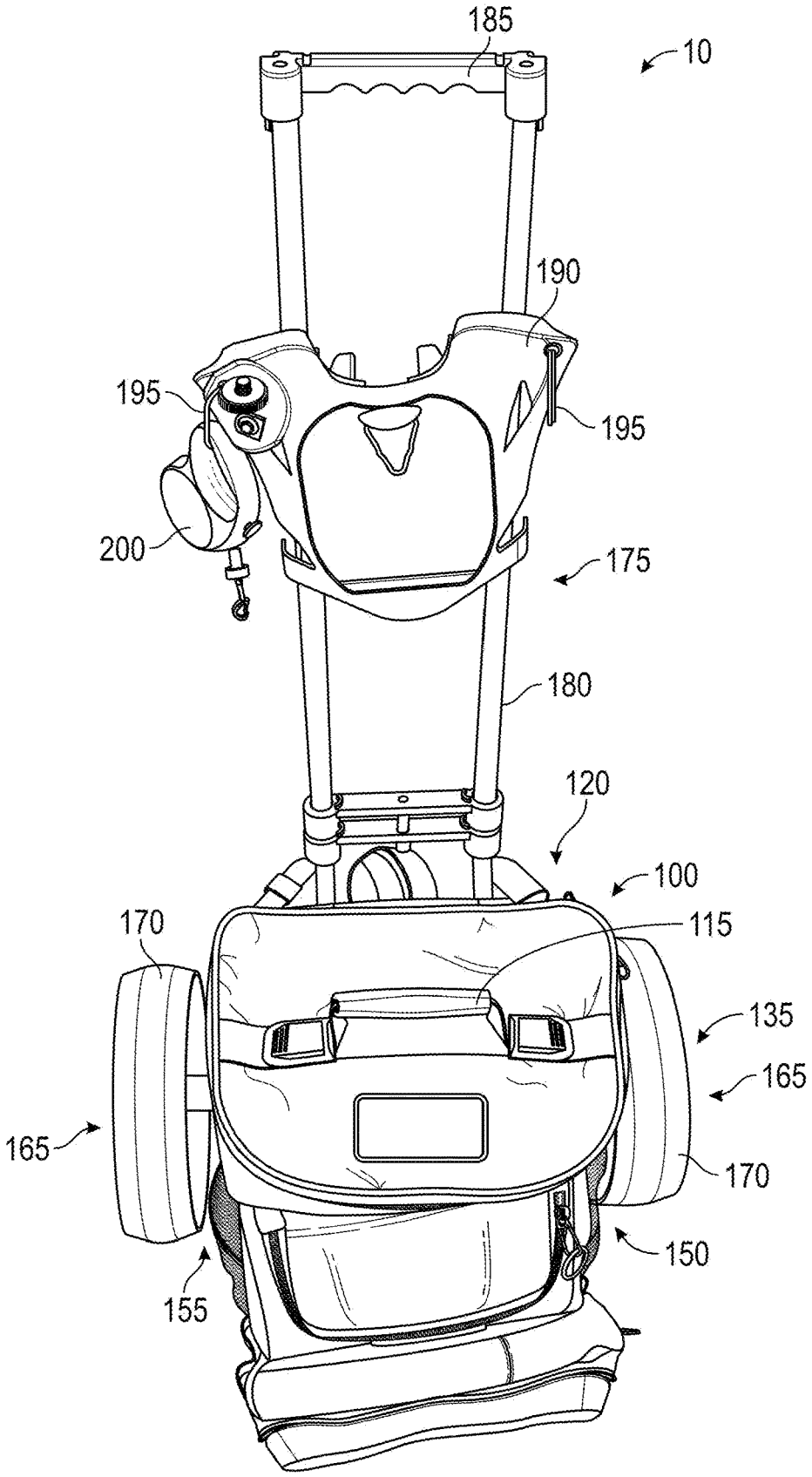
FIG. 2 illustrates a top perspective view of the wheeled backpack of FIG. 1, according to various examples of embodiments.
Figure 3:
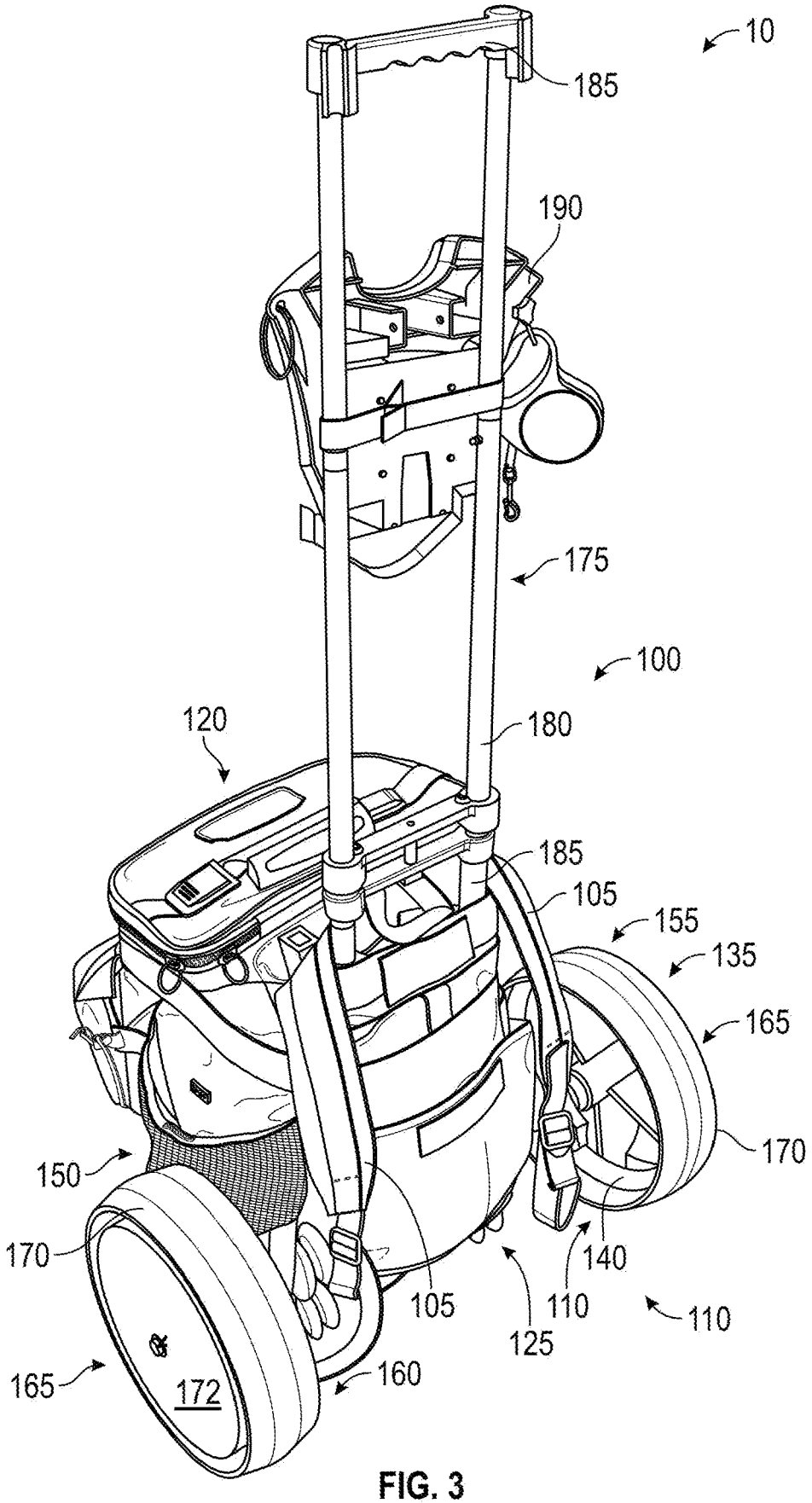
FIG. 3 illustrates a rear perspective view of the wheeled backpack of FIG. 1, according to various examples of embodiments.
Figure 4:
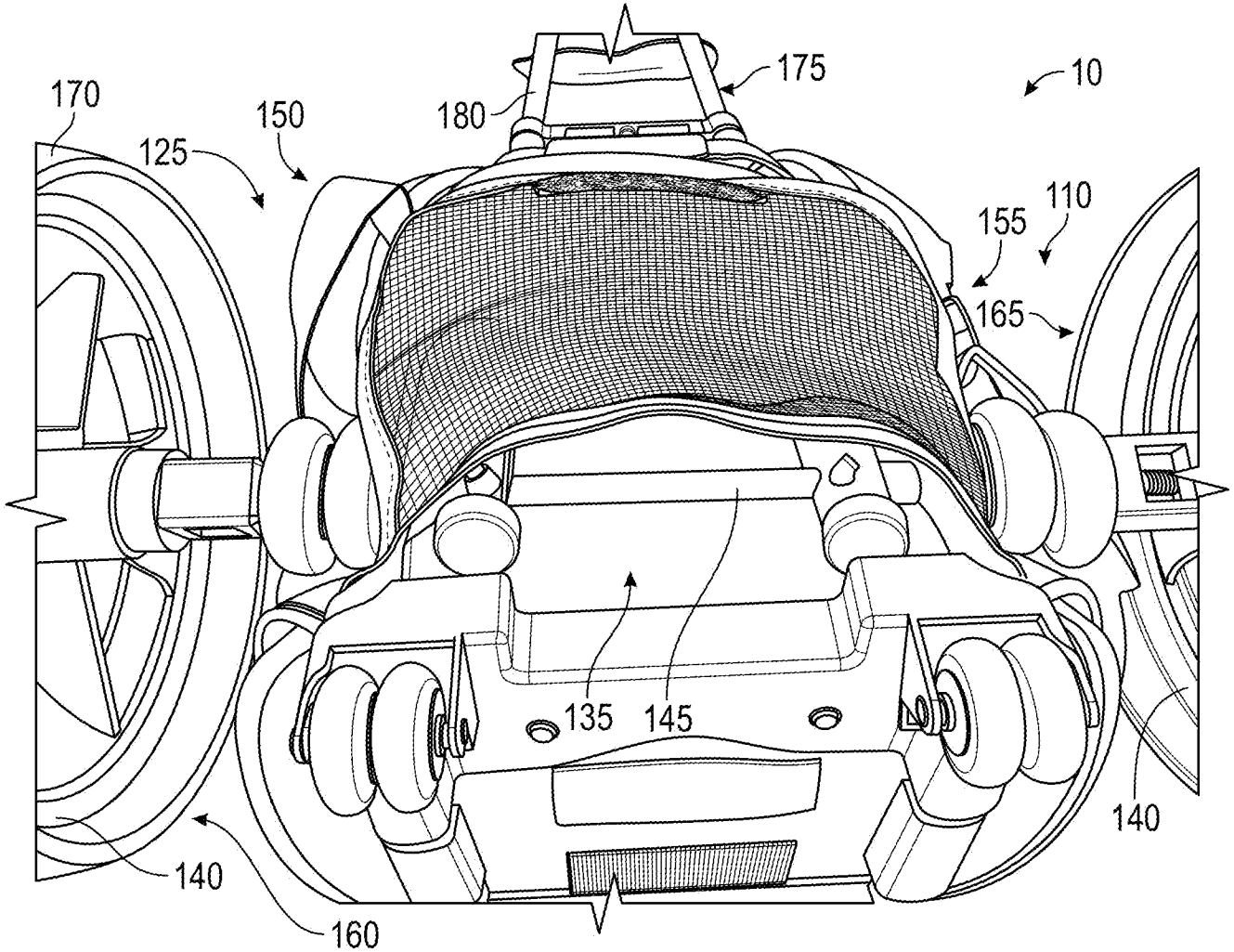
FIG. 4 illustrates a bottom perspective view of the wheeled backpack of FIG. 1, according to various examples of embodiments.
Figure 5:
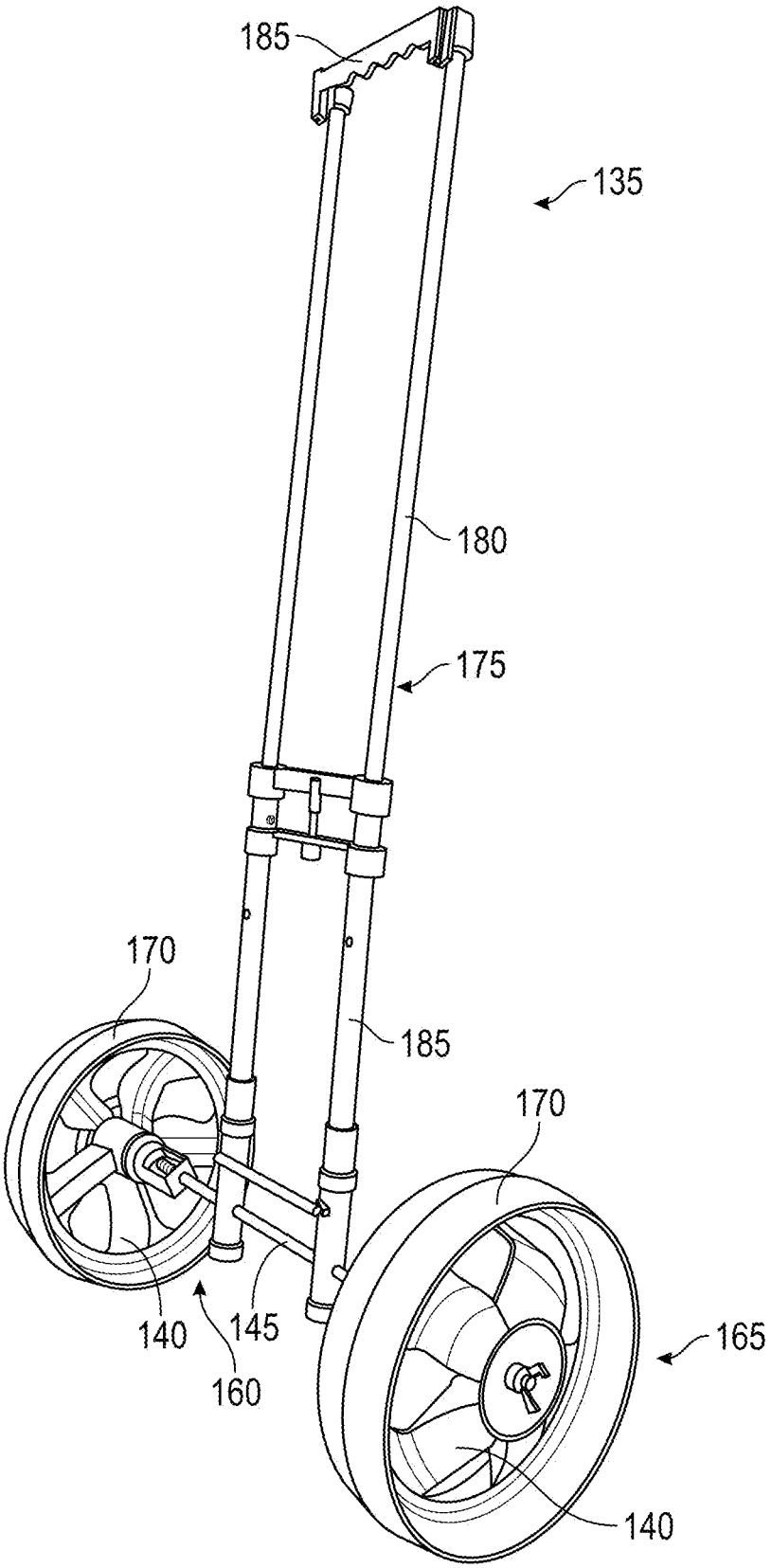
FIG. 5 illustrates a side perspective view of a wheeled assembly of the wheeled backpack of FIG. 1, according to various examples of embodiments.
Figure 6:
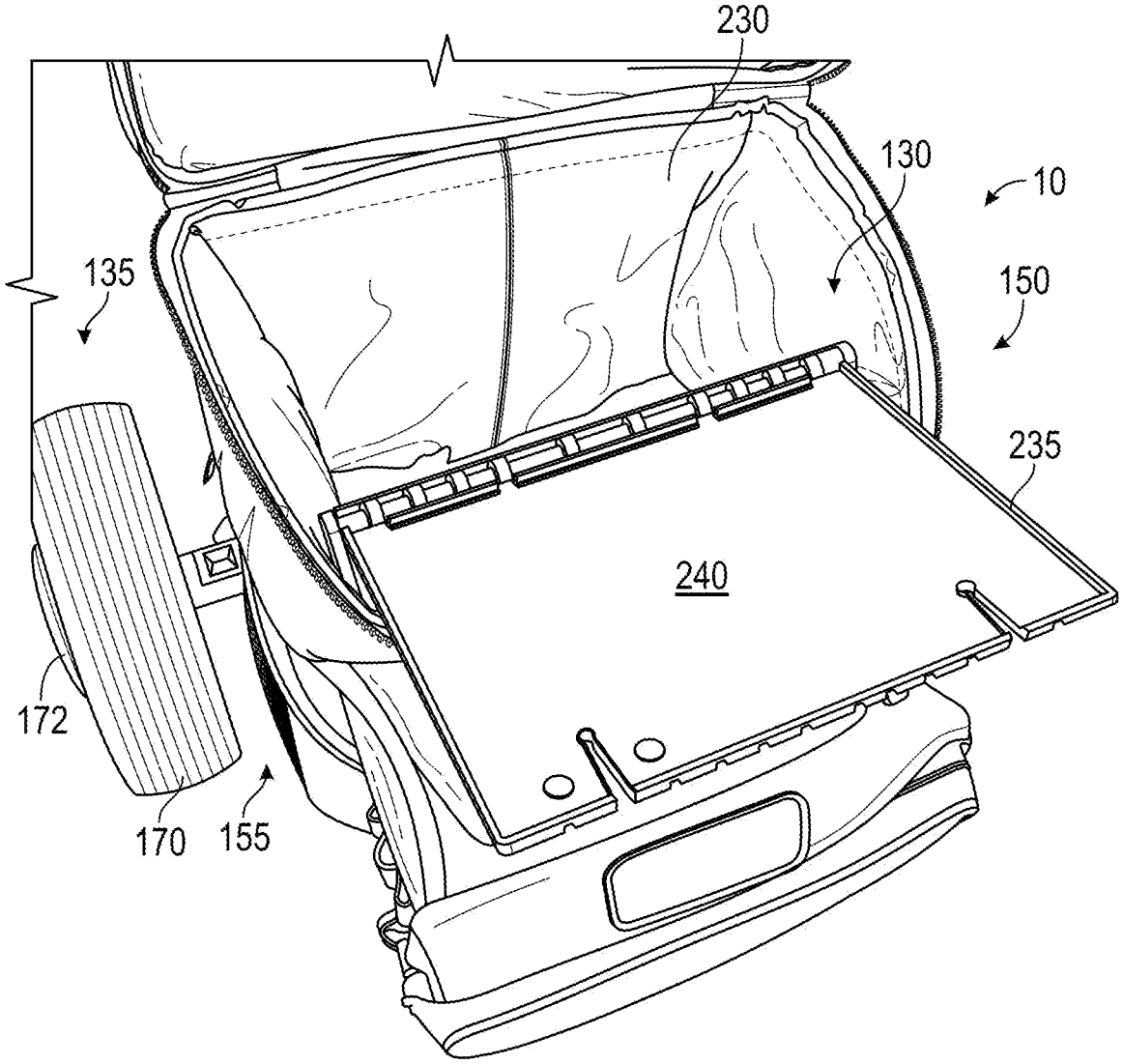
FIG. 6 illustrates a partial top perspective view of the wheeled backpack of FIG. 1, with a compartment open, according to various examples of embodiments.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

Referring to FIGS. 1-7, one or more embodiments of a wheeled backpack 10 are provided. The wheeled backpack may be used for disc golf (e.g., to carry discs, equipment, and supplies) and/or it may be used as a bag or luggage for transporting and/or transporting other things. Various applications include hiking, camping, travel, school, sports, mechanical, crafts, lawn and garden, office, photography, videography, factory or industrial, and military applications.

In various examples of embodiments, wheeled backpack 10 includes a backpack 100. In various examples of embodiments, backpack 100 includes one or more shoulder straps 105 coupled to a rear 110 of backpack 100. The shoulder straps may be adjustable. In various examples of embodiments, backpack 100 includes a handle 115 secured to a top 120 of backpack 100. In various embodiments, backpack 100 includes a lower portion 125.

In various examples of embodiments, backpack 100 includes a main compartment 130 and may be provided with additional compartments. The compartments are adapted and/or provided to hold or retain various objects. For example, the main compartment may be adapted to hold disc golf discs and/or other disc golf equipment. In various embodiments, one or more compartments may include an accordion style holder (e.g., for disc golf discs). In various examples of embodiments, the backpack includes a compartment for retaining a fluid source or reservoir (e.g., a hydration bladder, a water bladder, and/water reservoir for a hydration pack). In various examples of embodiments, the backpack includes a compartment (e.g., on rear or strap side of the backpack) for retaining personal items (e.g., a wallet, phone, passport or ID, etc.)

In various examples of embodiments, the backpack includes a compartment for retaining a pillow or other head support. In various embodiment, the head support compartment is provided on the rear or strap side of the backpack to also provide additional back, spinal and/or lumbar comfort and/or cushion to a user while wearing the backpack.

The backpack may be made from nylon, leather or some other durable fabric or material, and/or combinations of such fabrics or materials. For example, various embodiments of the backpack may be made with the following materials and/or combination of materials: cotton, canvas, nylon (e.g., ripstop nylon, ballistic nylon, kodra nylon, etc.), leather, denim, PVC, polyester, polypropylene, cordura, waterproof materials, etc. Although shown as a soft body or case (e.g., for storage of disc golf or other sports equipment), in various other embodiments, the backpack may be or include a rigid body case or bag of various configurations.

In various embodiments, wheeled backpack 10 includes a wheeled assembly 135 including and one or more wheels 140 that are removably coupled to a first axle 145 coupled to lower portion 125. In various embodiments, backpack 100 includes sides 150 and 155, and lower portion 125 includes sides 150/155 or portion of sides 150/155 of backpack 100 that are proximate to each wheel 140. In various embodiments, known golf cartwheels may be utilized. Custom wheel designs may also be utilized. In various embodiments, the wheels may be climbing wheels or climbing wheel sets. In various examples of embodiments, wheels 140 and/or first axle 145 are removable.

In various embodiments, the wheels may be removed or quick-released from the axle, and the wheels and axle may be stored (e.g., when not in use or when more convenient for storage of the backpack).

In various examples of embodiments, wheels 140 form a wheelbase that is relatively wider than or otherwise extends beyond or outside of a width of backpack 100 (e.g., a width adjacent to wheelbase, a width of lower portion 125, an average width of lower portion 125 or of backpack 100, a maximum width of lower portion 125 or of backpack 100, etc.) In various examples of embodiments, wheels 140 form a wheelbase that is relatively wider than or otherwise extends beyond or outside of a width of lower portion 125 of backpack 100.

In various examples of embodiments, lower portion 125 has a width or variable width and first axle 145 has an axle length, and the axle length is greater than the width, average width, or largest width of lower portion 125. In various embodiments, wheels 145 have an inner side 160 and an outer side 165. In various embodiments, outer side 165 of each wheel 145 extends or is otherwise provided beyond a periphery of lower portion 125 of backpack 100. In various embodiments, inner side 160 of each wheel 145 extends or is otherwise provided beyond the periphery of lower portion 125 of backpack 100.

The axle and/or wheelbase may be of a variety of lengths and/or adjustable to different lengths. For example, in such embodiments, the wheels may be positioned close to the backpack periphery or periphery of the lower portion, or moved away or spaced apart from the periphery of backpack or lower portion of backpack to create space, provide add stability, adjust relative to the sides of a wearer of the backpack, etc.

In various embodiments, tires 170 (e.g., never-go-flat or airless tires) are provided about a circumference of wheels 140. In various embodiments, tires 170 are provided or positioned outside the periphery or width of the backpack.

Such positioning of the wheels and the tires offers a number of advantages including, without limitation, allowing wheels (which may be larger than typical luggage wheels, e.g., to help navigate various terrain) to rest near the sides of a wearer of wheeled backpack 10 or spaced from rather than against or within the wearer's back. In various embodiments, space between the wheels (or width of the wheelbase) is adjustable to improve wearer fitment and/or stability of the wheelbase. In addition, the positioning of the wheels outside or beyond the periphery of the backpack or at least the lower portion improves the durability, stability and/or balance of the wheeled backpack, when at rest and/or when in motion. In various embodiments, the wheels may be spaced or otherwise provided such that they can rotate when the wheeled backpack is being worn on a user back, and the user can rotate or otherwise utilize the wheels as fidget spinners or the like (e.g., to improve concentration and focus, provide a sense of comfort during anxiety and in stressful situations, etc.).

In various other embodiments, the wheels may each have their own axle that can be coupled to one or more wheel or axle supports. In various embodiments, each such axle is shorter than a single axle configuration, which can be advantageous for storage of the axle(s) and wheel(s) when not coupled to the wheel support(s). In addition, in various examples of embodiments, individual wheel-axle combinations may allow for relatively more storage space underneath the backpack.

In various examples of embodiments, a hub cap 172 is removably coupled to axle 145 near at least one of wheels 140, or to at least one of wheels 140. In various examples of embodiments, the hub cap is a disc golf mini marker, which may be used to mark a disc golf lie as required or desired in most disc golf events. The marker may be made of wood, plastic, rubber, metal or any other material. In various examples of embodiments, the one or more markers are coupled to axle 145 or wheels 140 as hub caps, to keep them accessible, and/or prevent them from being lost or misplaced. In various embodiments, the markers define a hole at or near their center, through which axle 145 may be inserted. The hub cap may also serve as an eating plate, flying disc, etc.

In various examples of embodiments, wheeled assembly 135 also includes a handle assembly 175 coupled to axle 145. In various embodiments, one or more wheels 140 are removably secured to axle 145 that is coupled (e.g., rotatably and/or operatively coupled) to handle assembly 175. In various embodiments, one or more wheels 140 are removably secured to an axle that is provided in an axle tube coupled (e.g., operatively coupled) to the handle assembly. Such embodiments may provide added stability, strength and/or durability.

Handle assembly 175 may be any length, as desired, and it may be fixed in length (or otherwise static such that it does not telescope or otherwise adjust in length), or it may be telescoping or otherwise adjustable to various lengths. The telescoping handle assembly 175 may vary in length (e.g., when partially or fully extended). In various examples of embodiments, handle assembly 175 may formed of tubing (or lengths of tubing). While the tubing illustrated in the figures is square in cross section, the telescoping handle tubing can be circular, rectangle, square or any other cross-sectional shape tubing. It should be appreciated that the handle could be fixed (i.e., not adjustable or telescoping). In various embodiments, handle assembly 175 also includes concealed or hidden storage.

In various embodiments, handle assembly 175 includes a series of concentric or nesting metal or rigid plastic tubes including an inner or upper tube 180 that may be inserted into or withdrawn from an outer or lower tube 185 in a telescoping manner. In various embodiments, handle assembly 175 includes two parallel series of concentric tubes connected at a top by a handle or grip 185. The bases of the two series of concentric tubes are coupled to axle 145 and the outer or lower tubes are coupled to backpack 100 (e.g., rear or strap side of backpack) such that handle assembly 175 does not separate from backpack 100 (e.g., when fully extended). The handle assembly may also include a locking mechanism to maintain the handle assembly in a collapsed position and in an extended position, as desired.

In various embodiments, the telescoping handle may be foldable into a seat. In various examples of embodiments, the telescoping handle may be adjustable to be secured into a U-shape formed of two support sections coupled by a crossbar section that may be utilized as a seat or other support. In various embodiments, a pad or other component may be coupled to the crossbar section for comfort.

In various examples of embodiments, wheeled backpack 10 includes a storage compartment 190 coupled to or provided on handle assembly 175. Various items (e.g., pencils, scorecards, snacks, phones, etc.) may be at least temporarily stored or otherwise provided in storage compartment 190.

In various examples of embodiments, wheeled backpack 10 and/or handle assembly 175 includes or has coupled thereto one or more apparatus 195 (e.g., hooks (e.g., D hooks), lanyards (e.g., keychain lanyards), rings and/or one or more magnets to help retain (e.g., removably retain) one or more items. For example, the backpack and/or handle may include apparatus 195 for retaining a pet leash 200. In various embodiments, the apparatus 195 may be a headphone strap attachment coupled thereto.

Figure 7:
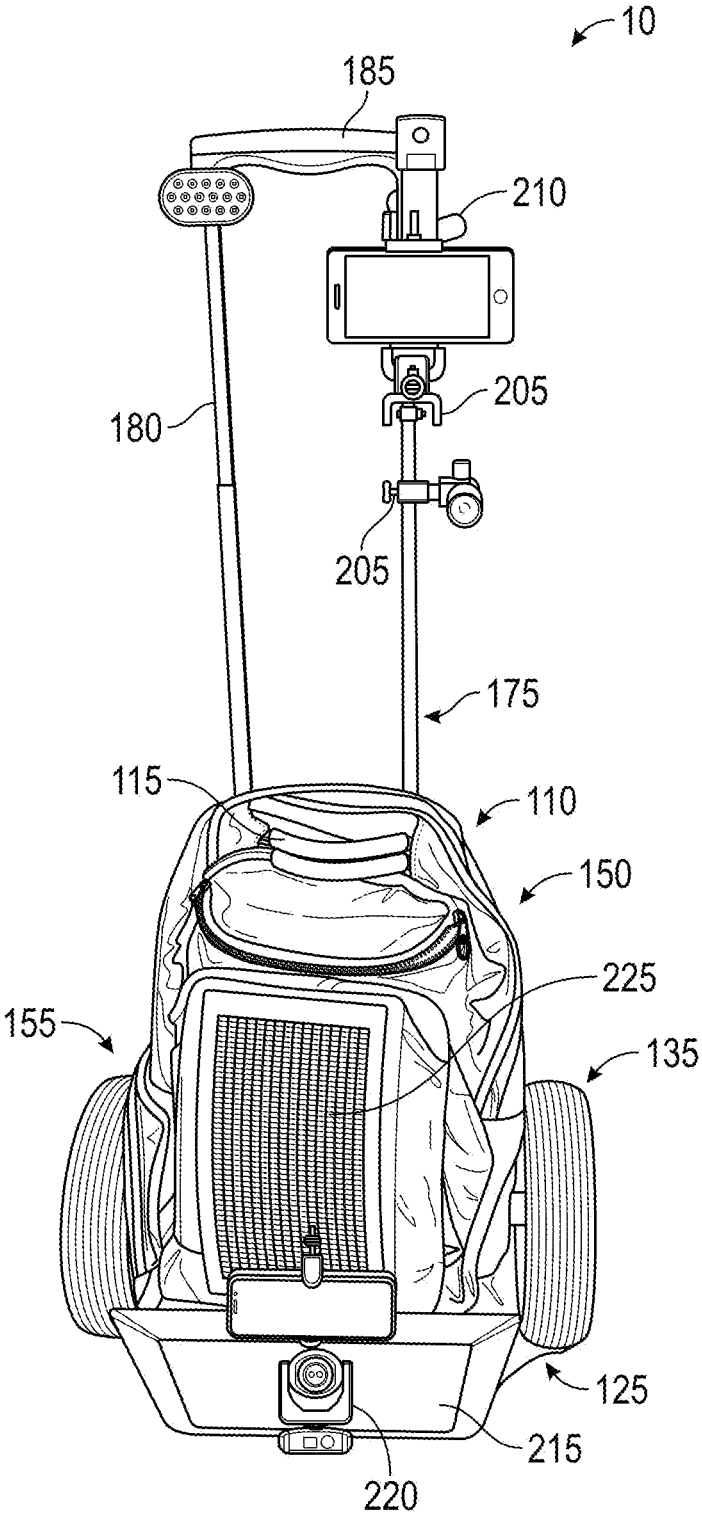
FIG. 7 illustrates a front perspective view of a wheeled backpack, according to various examples of embodiments.
Figure 8:
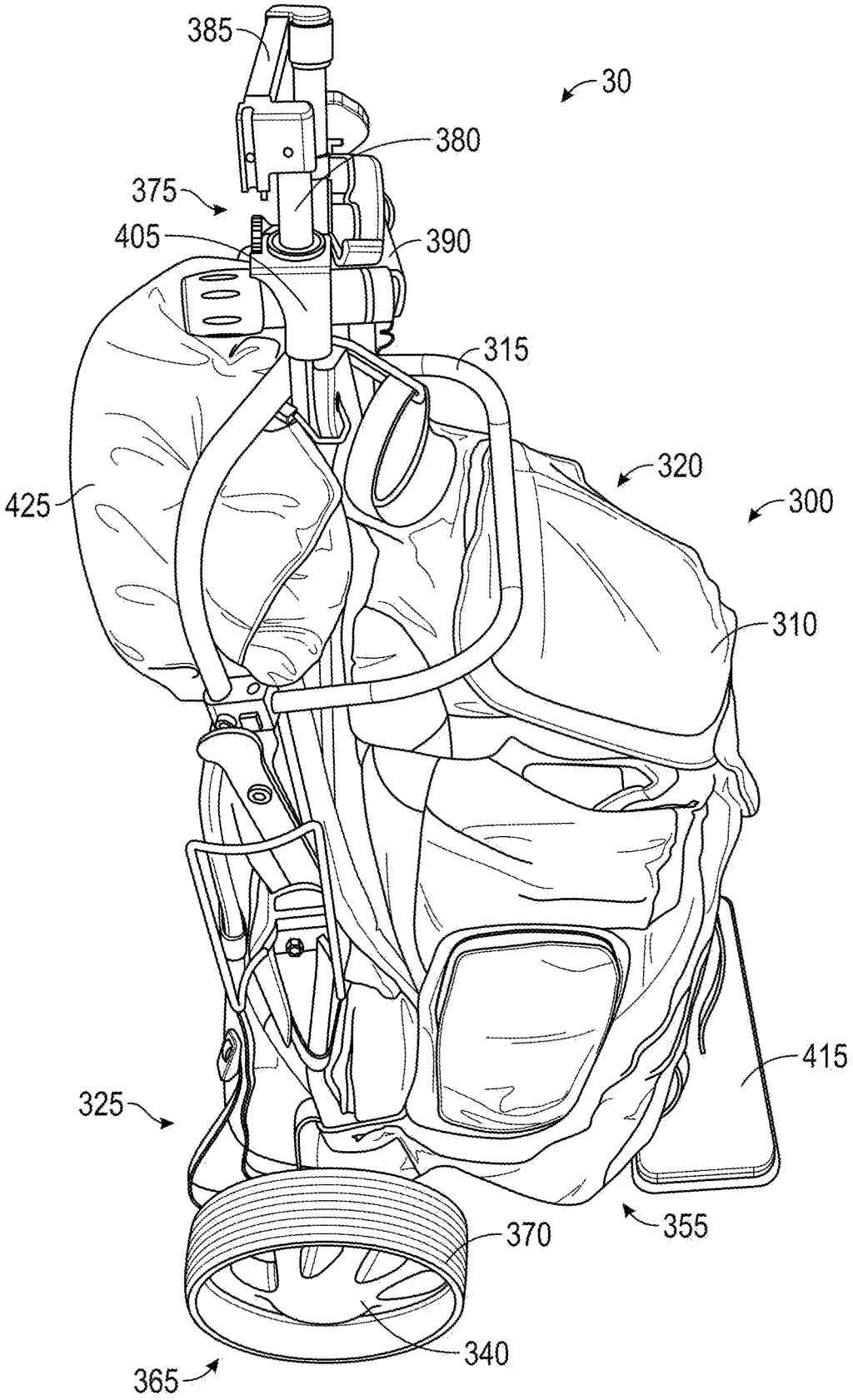
FIG. 8 illustrates a first side perspective view of a wheeled backpack, according to various examples of embodiments.
Figure 9:
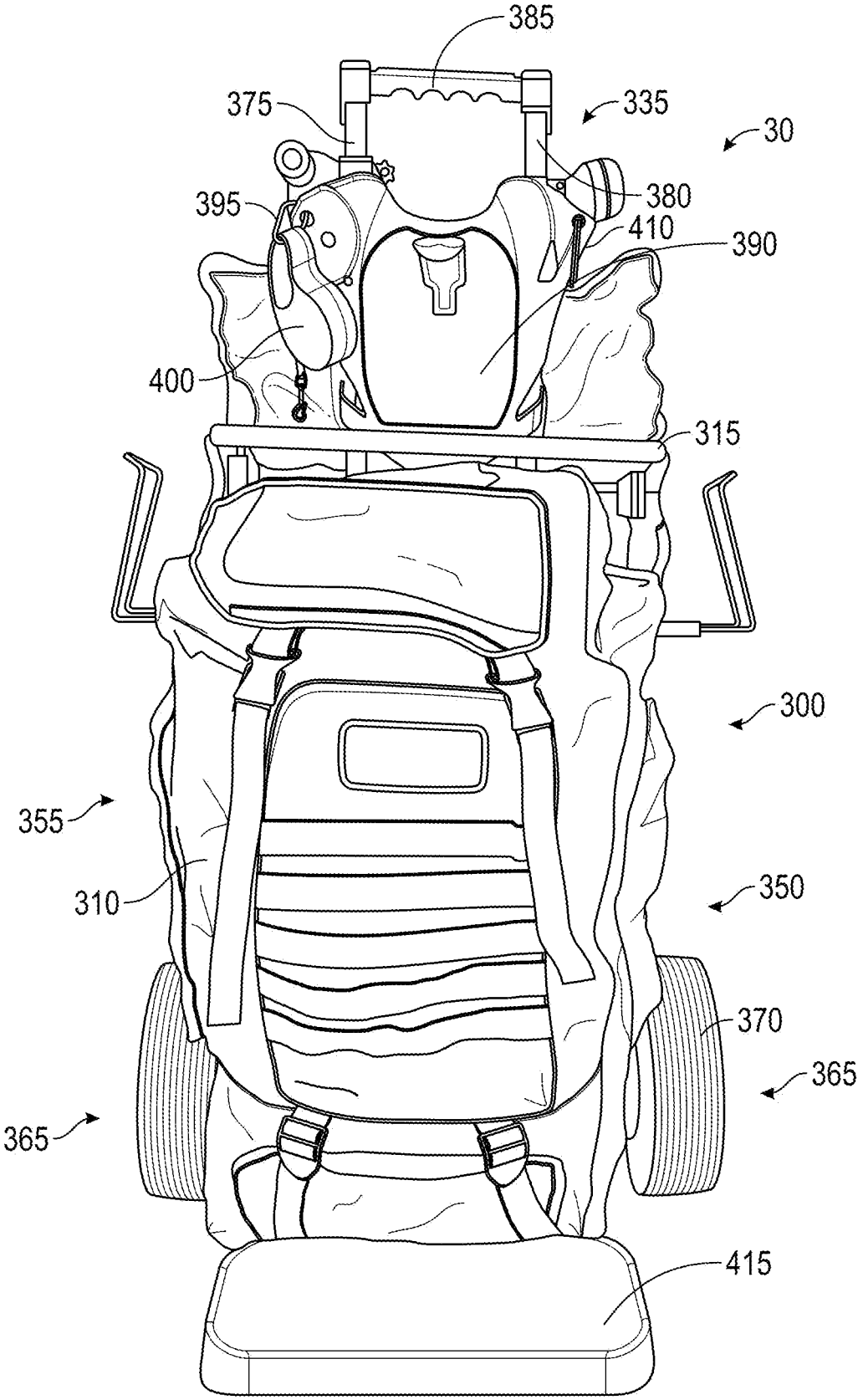
FIG. 9 illustrates a front perspective view of the wheeled backpack of FIG. 8, according to various examples of embodiments.
Figure 10:
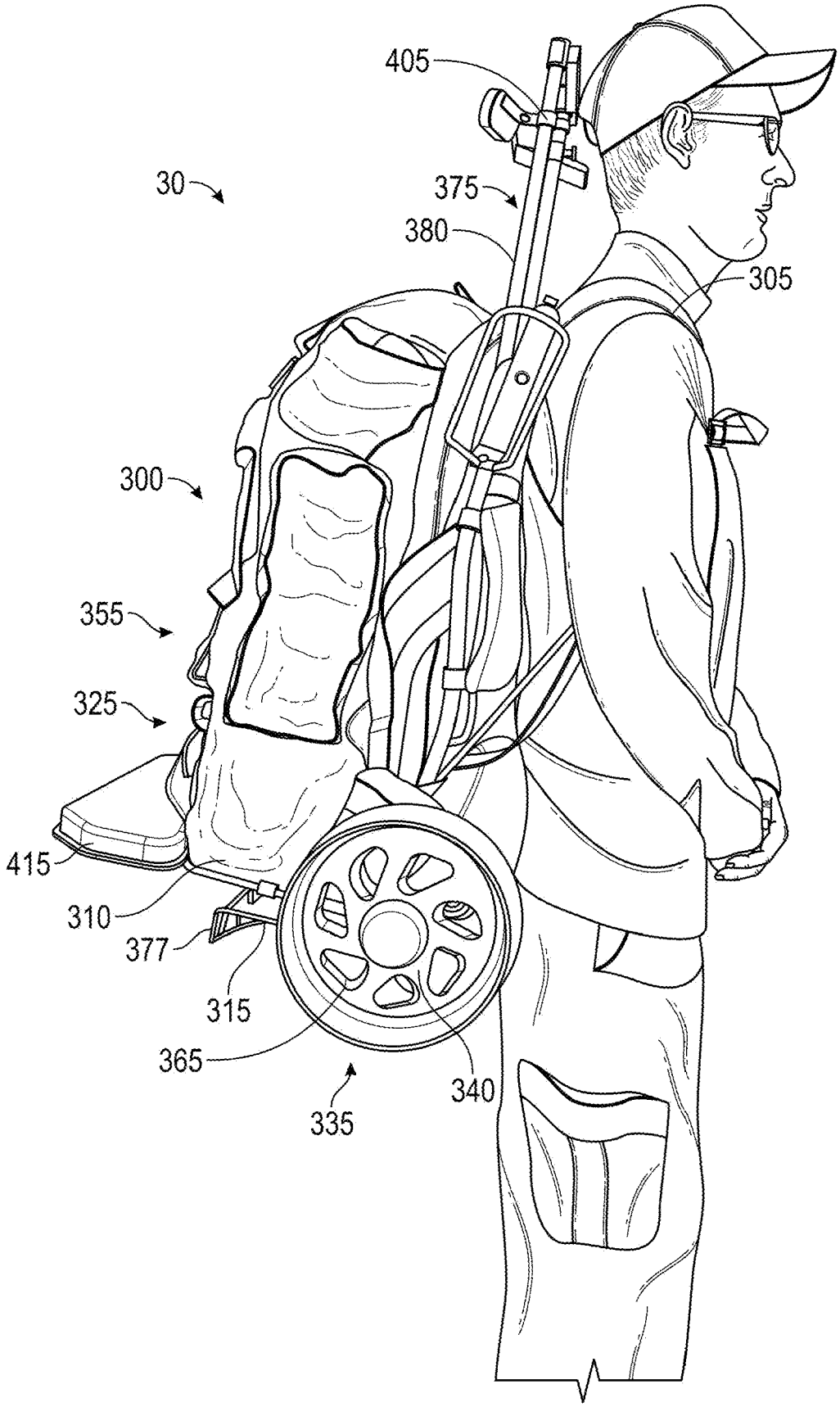
FIG. 10 illustrates a second side perspective view of the wheeled backpack of FIG. 8, worn by a user of the backpack, according to various examples of embodiments.
Figure 11:
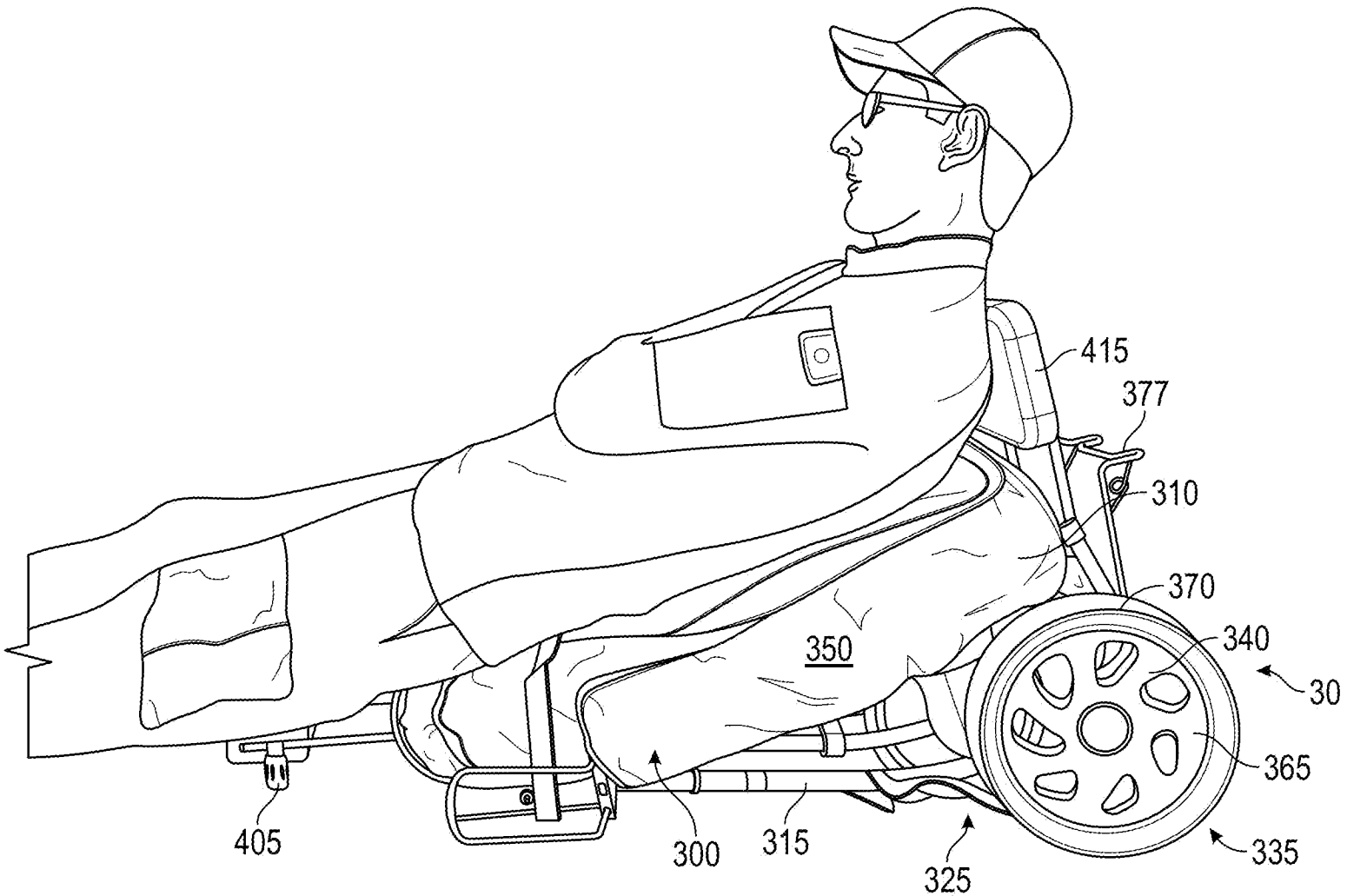

Referring now to FIG. 7, in various embodiments, one or more mounts 205 (e.g., removable and/or slidable) are coupled to handle assembly 175. For example, one or more mounts 205 for lights, cameras or other recording devices (including phones and smartphones), mobile or cellular devices, reflectors, etc. may be coupled to handle assembly 175. One or more such mounts 205 may be utilized to removably retain lights (e.g., spotlights, headlights, strobe lights, red flashing emergency lights (and/or combination lights) on or relative to handle assembly 175 to help light areas around the backpack and/or make the user more visible to others (e.g., while the user is wheeling or carrying the backpack, or when the backpack is resting on the ground). One or more such mounts 205 may also be utilized to removably retain a camera or recording device on handle assembly 175 to help record events, as desired (e.g., while the user is wheeling or carrying the backpack, or when the backpack is resting on the ground). One or more such mounts 205 may also be utilized to removably retain a mobile or cellular device (e.g., to allow hands free calling or other communication).

As another example, the handle may include one or more clips or other members 210 for removably retaining an umbrella, shovel, and/or tripod. The clips or members may be utilized to retain a closed umbrella, or the clips or members (or other clips or members) may be utilized to retain the handle or another component of an open umbrella (e.g., to protect the user when wheeling or carrying the backpack (e.g., from rain, sun and other elements). In various examples, one or more pins (e.g., locking pins), clamps or other devices or apparatus may be used to help secure the handle in full or partial extension.

In various examples of embodiments, a base 212 is provided between the wheels 140. In various embodiments, base 212 is coupled to axle 145. In various embodiments, base 212 is coupled to handle assembly 175 (e.g., to the bases of the two series of concentric tubes forming handle assembly 175).

In various examples of embodiments, storage (e.g., one or more removable storage trays) is provided between the wheels. One such storage tray may be useable (e.g., fireproof or heat resistant) as a plate, bowl or as a grill for a source of cooking heat such as a campfire. In various embodiments, one such tray may be provided below the main compartment and between the wheels and may be useable to retain an insulated food or beverage container (e.g., a cooler) and/or may be insulated (e.g., for use as a cooler or other insulated container).

In various embodiments, the backpack includes a plate or other support 215. In various examples of embodiments, plate or support 215 may be utilized to help stabilize the backpack and wheels when plate or support 215 is in contact with the ground or terrain. In various examples of embodiments, plate or support 215 may be utilized to help level backpack 100 or wheeled backpack 10 when plate or support 215 is in contact with the ground or terrain. In various embodiments, the location, size, weight, angle relative to other components of the backpack, and shape of the plate or support may be varied as desired based on the backpack features, size, placement of the plate or support relative to the wheels, and/or application. The plate or support may be customized with various identifiers, designs, etc.

In various examples of embodiments, wheeled backpack 10 is configured to be utilized as a seat and/or tray or another functional surface. For example, in various embodiments, a tripod or other stand or support may be coupled to an upper portion of the rear of wheeled backpack 10, or the upper portion of the rear of wheeled backpack 10 may be rested on a tripod, stand or other support. In various embodiments, the front of wheeled backpack 10 may then be utilized as a seat and/or plate or support 215 may be utilized as a tray (e.g., for eating) or other functional or support surface (e.g., for writing, supporting a mobile device, etc.).

In various examples of embodiments, a mount 220 (e.g., a light mount, a camera mount, and/or a phone or mobile device mount, is coupled to plate or support 215.

A light (e.g., a removeable, adjustable (e.g., tiltable and/or rotatable) LED light) may be coupled to the plate or support and/or a mount (e.g., a light mount) coupled to the plate or support. In various embodiments, the light may be coupled to a headband or strap to be worn as desired and when not mounted to the backpack light mount, support or plate.

In various embodiments, a camera or camera mount (e.g., built in Camera/GoPro Mount with Tilt) may be coupled to the plate or support. The wheeled backpack may then be rolled and used as a camera dolly.

In various embodiments, one or more solar panels 225 (e.g., removable solar panels) may be incorporated into the backpack. In various embodiments, the solar panels may be electrically coupled to a battery or charger for powering various devices. In various examples of embodiments, one or more lights, cameras, and other electronics may be chargeable and/or powered by solar power.

Referring again to FIG. 6, in various embodiments, wheeled backpack 10 includes an insulated compartment 225 and/or cooler, and/or at least partially houses a utility tray assembly 230. In various embodiments, a tray member 235 of folding utility tray assembly 230 may be unfolded or otherwise extended outside an interior of backpack 100. Tray member 235 may be used to hold or otherwise support belongings (e.g., a mobile phone, tablet, food, etc.). In various embodiments, tray member 235 and/or folding utility tray assembly 230 may be folded or collapsed into the interior of the backpack for storage, as desired.

Referring to FIGS. 8-21, one or more embodiments of a wheeled backpack 30 are provided. The wheeled backpack may be used for disc golf (e.g., to carry discs, equipment, and supplies) and/or it may be used as a bag or luggage for transporting and/or transporting other things. Various applications include hiking, camping, travel, school, sports, mechanical, crafts, lawn and garden, office, photography, videography, factory or industrial, and military applications.

In various examples of embodiments, wheeled backpack 30 includes a backpack 300. In various examples of embodiments, backpack 300 includes one or more shoulder straps 305, and a pack bag 310 coupled to a rigid, tubular frame 315 (e.g., formed of aluminum or other metals or rigid materials) by, for instance, stitching a sleeve, loop or pocket formed on the pack bag over a portion of the frame members. The frame may be external or internal to the pack bag. The shoulder straps may be adjustable. In various examples of embodiments, backpack 300 includes a lower portion 325.

In various examples of embodiments, backpack 300 includes a main compartment 330 and may be provided with additional compartments. The compartments are adapted and/or provided to hold or retain various objects. In various examples of embodiments, the backpack includes a compartment for retaining a fluid source or reservoir (e.g., a hydration bladder, a water bladder, and/water reservoir for a hydration pack). In various examples of embodiments, the backpack includes a compartment (e.g., on rear or strap side 320 of the pack bag 310) for retaining personal items (e.g., a wallet, phone, passport or ID, etc.). In various examples of embodiments, one or more compartments may hold or retain bulletproof or bullet resistant material.

In various examples of embodiments, the backpack includes a compartment for retaining a pillow or other head support. In various embodiment, the head support compartment is provided on the rear or strap side of the backpack to also provide additional back, spinal and/or lumbar comfort and/or cushion to a user while wearing the backpack.

The backpack may be made from nylon, leather or some other durable fabric or material, and/or combinations of such fabrics or materials. For example, various embodiments of the backpack may be made with the following materials and/or combination of materials: cotton, canvas, nylon (e.g., ripstop nylon, ballistic nylon, kodra nylon, etc.), leather, denim, PVC, polyester, polypropylene, cordura, waterproof materials, etc. Although shown as a soft body or case, in various other embodiments, the pack bag may be a rigid body case or bag of various configurations.

In various embodiments, wheeled backpack 30 includes a wheeled assembly 335 including and one or more wheels 340 that are removably coupled to a first axle 345 coupled to lower portion 325. In various embodiments, backpack 300 includes sides 350 and 355, and lower portion 325 includes sides 350/355 or portion of sides 350/355 of backpack 300 that are proximate to each wheel 340. In various embodiments, known golf cart wheels may be utilized. Custom wheel designs may also be utilized. In various embodiments, the wheels may be climbing wheels or climbing wheel sets. In various examples of embodiments, first axle 345 is removable.

In various embodiments, the wheels may be quick released from the axle, and the wheels and axle may be stored (e.g., when not in use or when more convenient for storage of the backpack).

In various examples of embodiments, wheels 340 form a wheelbase that is relatively wider than or otherwise extends beyond or outside of a width of backpack 300. In various examples of embodiments, wheels 340 form a wheelbase that is relatively wider than or otherwise extends beyond or outside of a width of lower portion 325 of backpack 300.

In various examples of embodiments, lower portion 325 has a width or variable width and first axle 345 has an axle length, and the axle length is greater than the width or average or largest width of lower portion 325. In various embodiments, wheels 345 have an inner side 360 and an outer side 365. In various embodiments, outer side 365 of each wheel 345 extends or is otherwise provided beyond a periphery of lower portion 325 of backpack 300. In various embodiments, inner side 360 of each wheel 345 extends or is otherwise provided beyond the periphery of lower portion 325 of backpack 300.

The axle and/or wheelbase may be of a variety of lengths and/or adjustable to different lengths. For example, in such embodiments, the wheels may be positioned close to the backpack periphery or periphery of the lower portion, or moved away or spaced apart from the periphery of backpack or lower portion of backpack to create space, provide add stability, adjust relative to the sides of a wearer of the backpack, etc.

In various embodiments, tires 370 (e.g., never-go-flat or airless tires) are provided about a circumference of wheels 340. In various embodiments, tires 370 are provided or positioned outside the periphery or width of the backpack.

Such positioning of the wheels and the tires offers a number of advantages including, without limitation, allowing wheels (which may be larger than typical luggage wheels, e.g., to help navigate various terrain) to rest near the sides of a wearer of wheeled backpack 30 or spaced from rather than against or within the wearer's back. In various embodiments, space between the wheels (or width of the wheelbase) is adjustable to improve wearer fitment and/or stability of wheelbase. In addition, the positioning of the wheels outside or beyond the periphery of the backpack or at least the lower portion improves the durability, stability and/or balance of the wheeled backpack, when at rest and/or when in motion. In various embodiments, the wheels may be spaced or otherwise provided such that they can rotate when the wheeled backpack is being worn on a user back, and the user can rotate or otherwise utilize the wheels as fidget spinners or the like (e.g., to improve concentration and focus, provide a sense of comfort during anxiety and in stressful situations, etc.).

In various other embodiments, the wheels may each have their own axle that can be coupled to one or more wheel or axle supports. In various embodiments, each such axle is shorter than a single axle configuration, which can be advantageous for storage of the axle(s) and wheel(s) when not coupled to the wheel support(s). In addition, in various examples of embodiments, individual wheel-axle combinations may allow for relatively more storage space underneath the backpack.

In various examples of embodiments, a hub cap 372 is removably coupled to axle 345 near at least one of wheels 340, or to at least one of wheels 340. In various examples of embodiments, the hub cap is a disc golf mini marker, which may be used to mark a disc golf lie as required or desired in most disc golf events. The marker may be made of wood, plastic, rubber, metal or any other material. In various examples of embodiments, the one or more markers are coupled to axle 345 or wheels 340 as hub caps, to keep them accessible, and/or prevent them from being lost or misplaced. In various embodiments, the markers define a hole at or near their center, through which axle 345 may be inserted. The hub cap may also serve as an eating plate, flying disc, etc.

In various examples of embodiments, wheeled assembly 335 also includes a handle assembly 375 coupled to axle 345. In various embodiments, one or more wheels 340 are removably secured to axle 345 that is coupled (e.g., rotatably and/or operatively coupled) to handle assembly 375. In various embodiments, the one or more wheels are removably secured to an axle that is provided in an axle tube coupled (e.g., operatively coupled) to the handle assembly. Such embodiments may provide added stability, strength and/or durability.

In various embodiments, wheeled assembly 335 also includes a platform or rack 377. In various embodiments, rack 377 is coupled to handle assembly 375 (e.g., to form or act as a hand truck). Rack 377 may also be coupled to one or more wheels.

Handle assembly 375 may be any length, as desired, and it may be fixed in length, or it may be telescoping or otherwise adjustable to various lengths. The telescoping handle assembly 375 may vary in length (e.g., when partially or fully extended). In various examples of embodiments, handle assembly 375 may formed of tubing (or lengths of tubing). While the tubing illustrated in the figures is square in cross section, the telescoping handle tubing can be circular, rectangle, square or any other cross-sectional shape tubing. In various embodiments, handle assembly 375 also includes concealed or hidden storage.

In various embodiments, handle assembly 375 includes a series of concentric or nesting metal or rigid plastic tubes including an inner or upper tube 380 that may be inserted into or withdrawn from an outer or lower tube 385 in a telescoping manner. In various embodiments, handle assembly 375 includes two parallel series of concentric tubes connected at a top by a handle or grip 385. The bases of the two series of concentric tubes are coupled to axle 345 and the outer or lower tubes are coupled to backpack 300 (e.g., rear or strap side of backpack) such that handle assembly 375 does not separate from backpack 300 (e.g., when fully extended). The handle assembly may also include a locking mechanism to maintain the handle assembly in a collapsed position and in an extended position, as desired.

In various examples of embodiments, wheeled backpack 10 includes a storage compartment 390 coupled to or provided on handle assembly 375. Various items (e.g., pencils, scorecards, snacks, phones, etc.) may be at least temporarily stored or otherwise provided in storage compartment 390.

In various examples of embodiments, wheeled backpack 30 and/or handle assembly 375 includes or has coupled thereto one or more apparatus 395 (e.g., hooks (e.g., D hooks), lanyards (e.g., keychain lanyards), rings and/or one or more magnets to help retain (e.g., removably retain) one or more items. For example, the backpack and/or handle may include apparatus 395 for retaining a pet leash 400. In various embodiments, the apparatus 395 may be a headphone strap attachment coupled thereto.

Referring now to FIG. 7, one or more mounts 405 (e.g., removable and/or slidable) are coupled to handle assembly 375. For example, one or more mounts 405 for lights, cameras or other recording devices (including phones and smartphones), mobile or cellular devices, reflectors, etc. may be coupled to handle assembly 375. One or more such mounts 405 may be utilized to removably retain lights (e.g., spotlights, headlights, strobe lights, red flashing emergency lights (and/or combination lights) on or relative to handle assembly 375 to help light areas around the backpack and/or make the user more visible to others (e.g., while the user is wheeling or carrying the backpack, or when the backpack is resting on the ground). One or more such mounts 405 may also be utilized to removably retain a camera or recording device on handle assembly 375 to help record events, as desired (e.g., while the user is wheeling or carrying the backpack, or when the backpack is resting on the ground). One or more such mounts 405 may also be utilized to removably retain a mobile or cellular device (e.g., to allow hands free calling or other communication).

As another example, the handle may include one or more clips or other members 410 for removably retaining an umbrella, shovel, and/or tripod. The clips or members may be utilized to retain a closed umbrella, or the clips or members (or other clips or members) may be utilized to retain the handle or another component of an open umbrella (e.g., to protect the user when wheeling or carrying the backpack (e.g., from rain, sun and other elements). In various examples, one or more pins (e.g., locking pins), clamps or other devices or apparatus may be used to help secure the handle in full or partial extension. In various embodiments, a storage bag (e.g., for storing or retaining a water bottle, phone, etc. may be coupled to the hand assembly. In various examples to embodiments, a cooler or insulated bag may be removably coupled to the handle assembly or the frame.

In various examples of embodiments, the wheeled assembly is not coupled or integral to the backpack, bag or luggage. For example, the wheeled assembly may be a freestanding cart or hand cart configured to carry or retain a backpack, bag or luggage. In various examples of embodiments, the wheeled assembly may be retrofit to an existing backpack.

The wheeled backpack with axle and wheels may also have ball joints, struts, shocks, and springs to prevent the shock of impact from being transmitted to the body of the backpack and handle. There are other ball-in-socket steering components that could be used such as tie rods.

The wheeled backpack may also be motorized and/or self-propelled (or provide similar assistance) for the user. In addition, the wheeled backpack may include Bluetooth and/or other remote operation and control.

In various examples of embodiments, storage (e.g., one or more removable storage trays) is provided between the wheels. One such storage tray may be useable (e.g., fireproof or heat resistant) as a plate, bowl or as a grill for a source of cooking heat such as a campfire. In various embodiments, one such tray may be provided below the main compartment and between the wheels and may be useable to retain an insulated food or beverage container (e.g., a cooler) and/or may be insulated (e.g., for use as a cooler or other insulated container).

In various embodiments, wheeled backpack 30 includes a plate or other support 415. In various examples of embodiments, plate or support 415 is coupled to wheeled backpack 30 or rack 377 or external frame 315 of wheeled backpack 30 and may be utilized to help stabilize the backpack and wheels when plate or support 415 is in contact with the ground or terrain. In various examples of embodiments, plate or support 415 may also be utilized as a backrest when wheeled backpack is used as a seat or support surface (e.g., as illustrated more particularly in FIG. 11). In various embodiments, plate or support 415 includes a seat (e.g., a cushioned folding stadium seat). In various embodiments, plate or support 415 is coupled (e.g., rotatably coupled) to a second plate or support (e.g., including a cushion) and can be removed from the wheeled backpack to serve as a freestanding sitting surface of seat with backrest.

In various embodiments, one or more cup holders 420 may be coupled to frame 315. In various embodiments, cupholders 420 are rotatably coupled to frame 315 so they may be oriented relative to frame, as desired, depending on whether the wheeled backpack 30 is upright or on its side as a seat or other support surface. Cupholders 420 may be rotatable up to three hundred sixty degrees (e.g. to accommodate different wheeled backpack positions (e.g., standing upright, tilted for walking, laying down for sitting, etc.).

In various embodiments, one or more pillows or other cushions or supports 425 (e.g., a neck support and/or a back support may be included with wheeled backpack 30 (e.g., coupled to frame 315 and/or handle assembly 375) to provide or improve user support or comfort.

Figure 12:
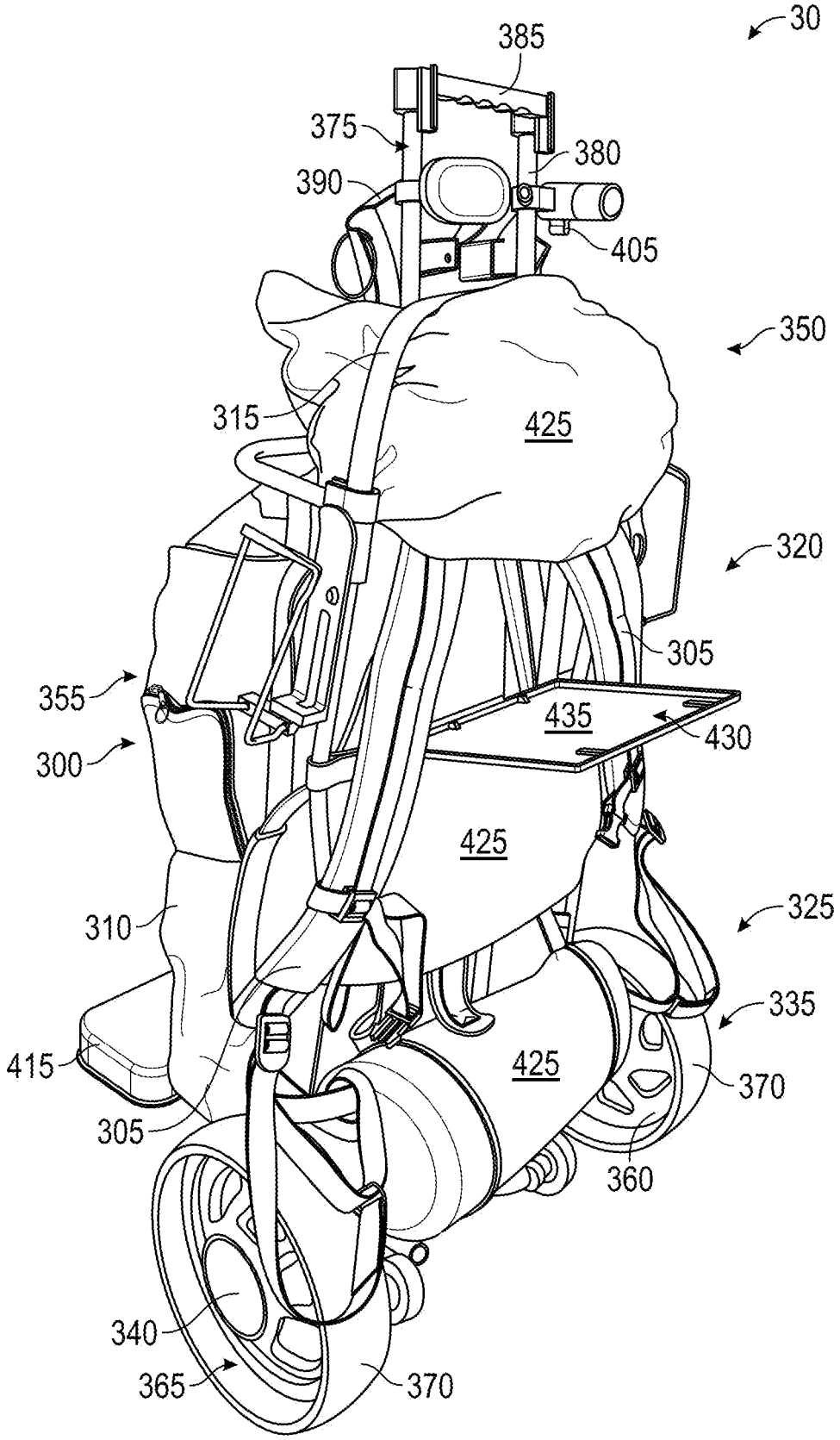
FIG. 12 illustrates a rear perspective view of the wheeled backpack of FIG. 8, according to various examples of embodiments.

Referring more specifically to FIG. 12, in various embodiments, wheeled backpack 30 includes a utility tray assembly 430. In various embodiments, a tray member 435 of folding utility tray assembly 430 may be provided behind a cushion or support 425 and unfolded or otherwise extended away from backpack 300. Tray member 435 may be used to hold or otherwise support belongings (e.g., a mobile phone, tablet, food, etc.). In various embodiments, tray member 435 and/or folding utility tray assembly 430 may be folded or collapsed, as desired.

Figure 13:
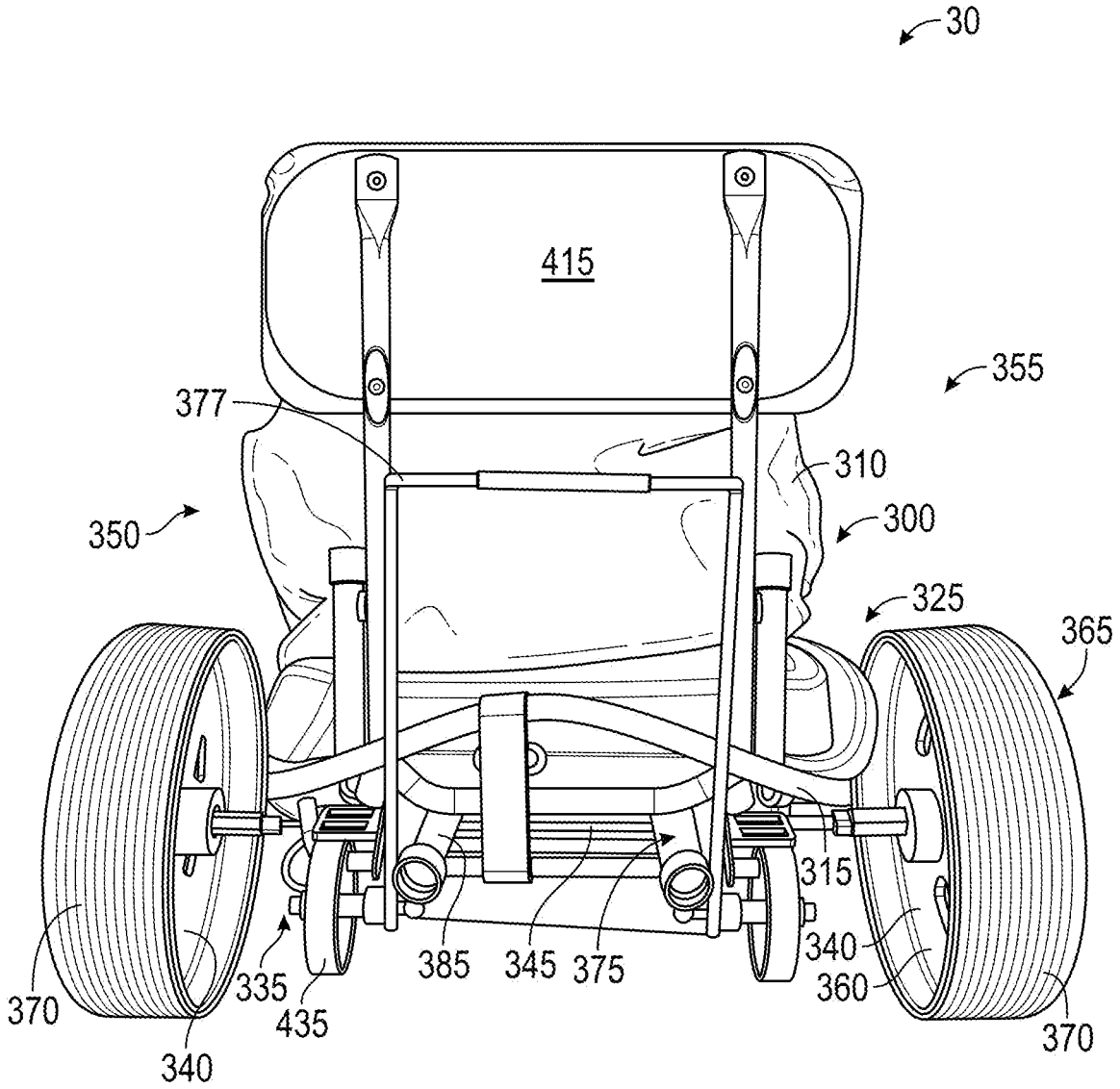
FIG. 13 illustrates a bottom perspective view of the wheeled backpack of FIG. 8, according to various examples of embodiments.
Figure 14:
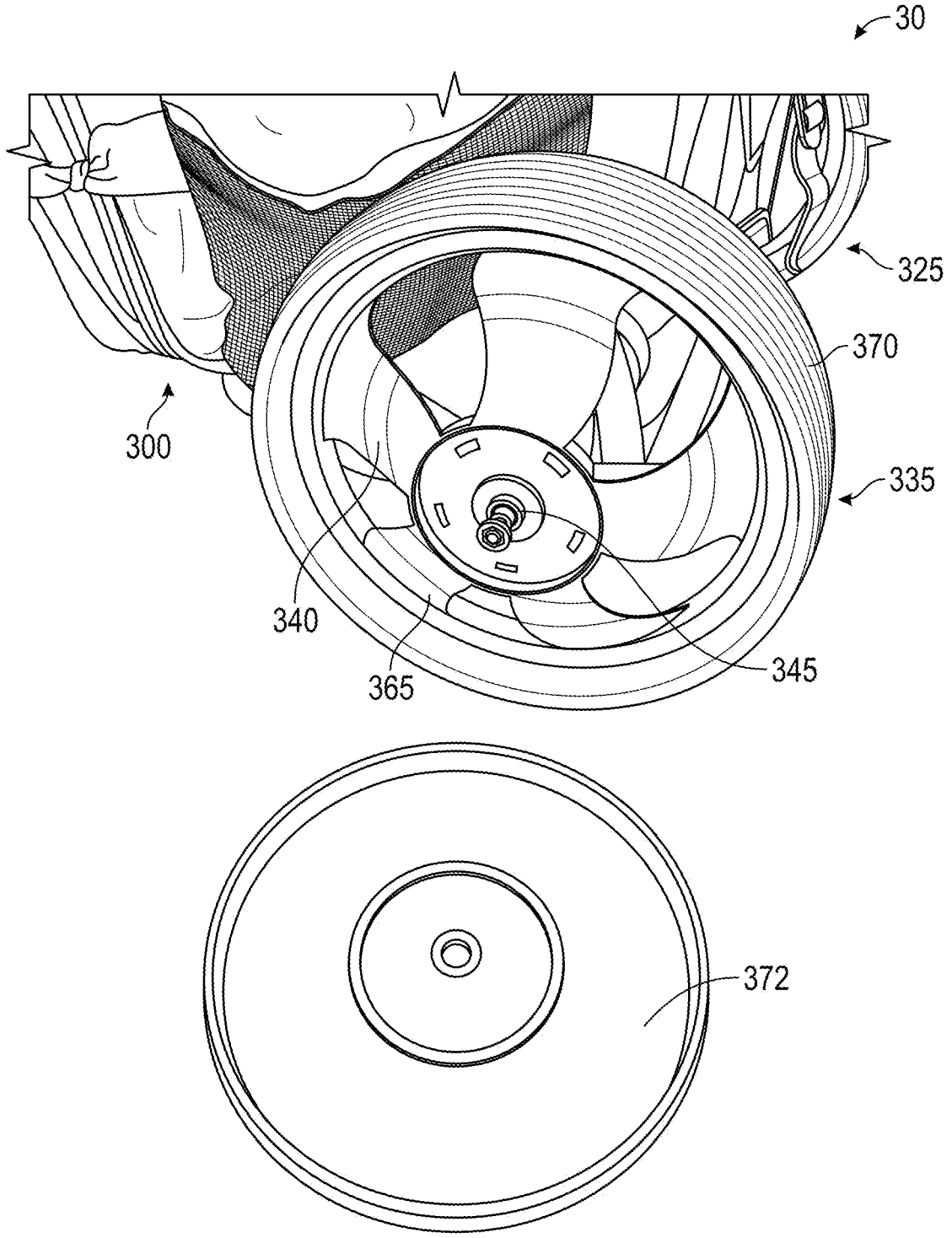
FIG. 14 illustrates a partial side perspective view of the wheeled backpack of FIG. 1, with a disc removed, according to various examples of embodiments.
Figure 15:
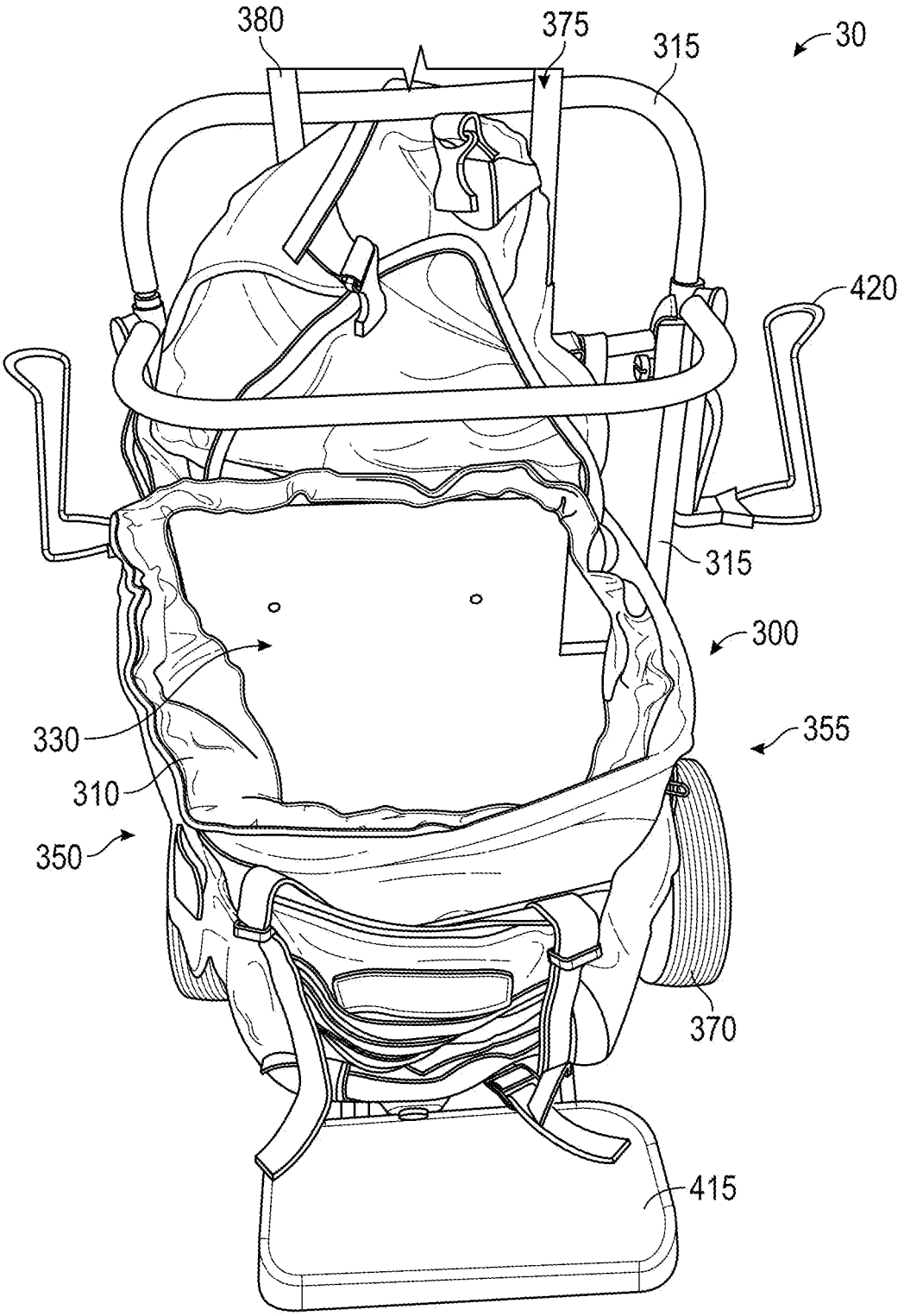
FIG. 15 illustrates a partial top perspective view of the wheeled backpack of FIG. 8, with a compartment open, according to various examples of embodiments.
Figure 16:
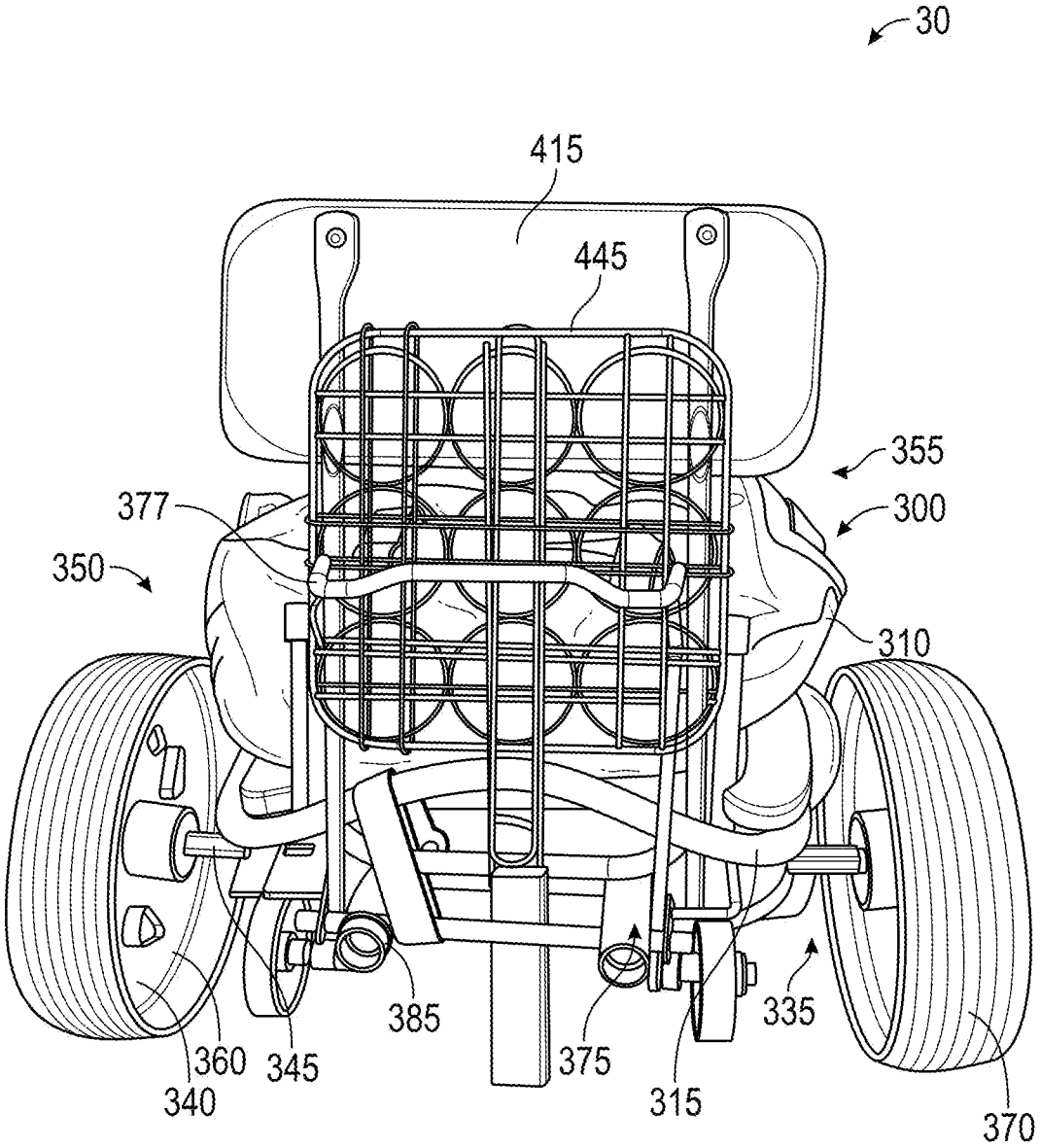
FIG. 16 illustrates a bottom perspective view of the wheeled backpack of FIG. 8, according to various examples of embodiments.
Figure 17:
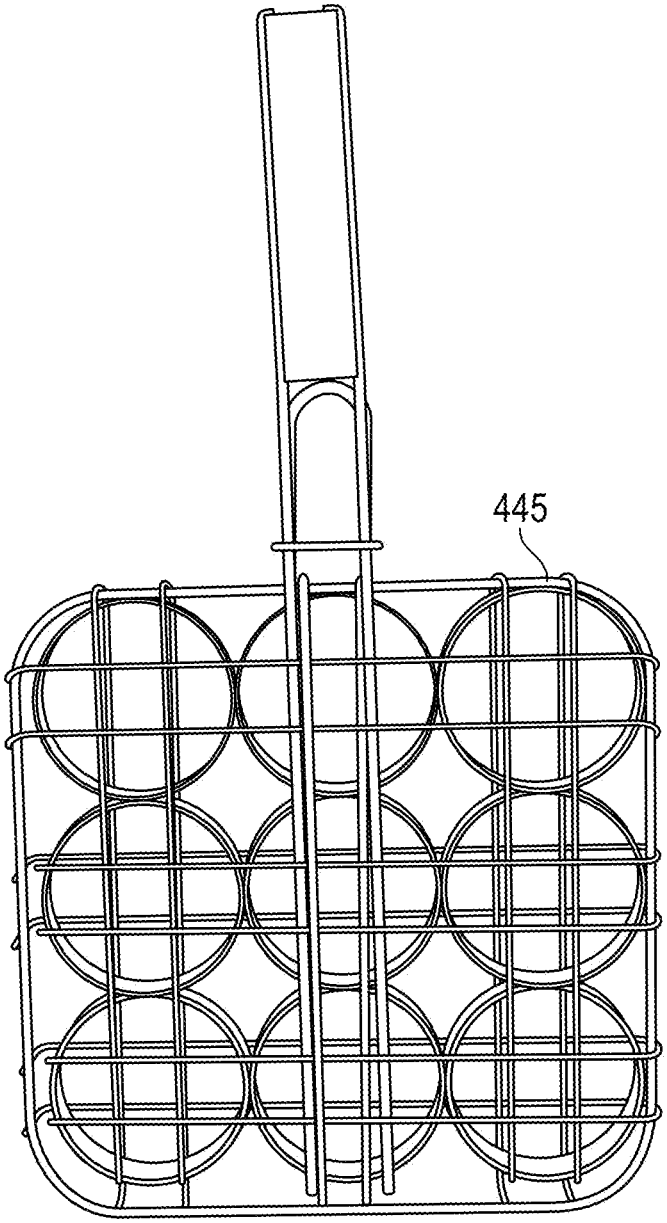
FIG. 17 illustrates a top perspective view of a grill tool of the wheeled backpack of FIG. 8, according to various examples of embodiments.

Referring more specifically to FIG. 13, in various embodiments, wheeled backpack 30 includes one or more support wheels or rollers 425 (e.g., operatively coupled to rack 377 provided between wheels 340). Such wheels or rollers 425 may be useful in navigating terrain too narrow to be easily navigated by wheels 340. Referring more specifically to FIG. 16, rack 377 may be used to help retain other tools or apparatus (e.g., a grill apparatus 445).

Figure 18:
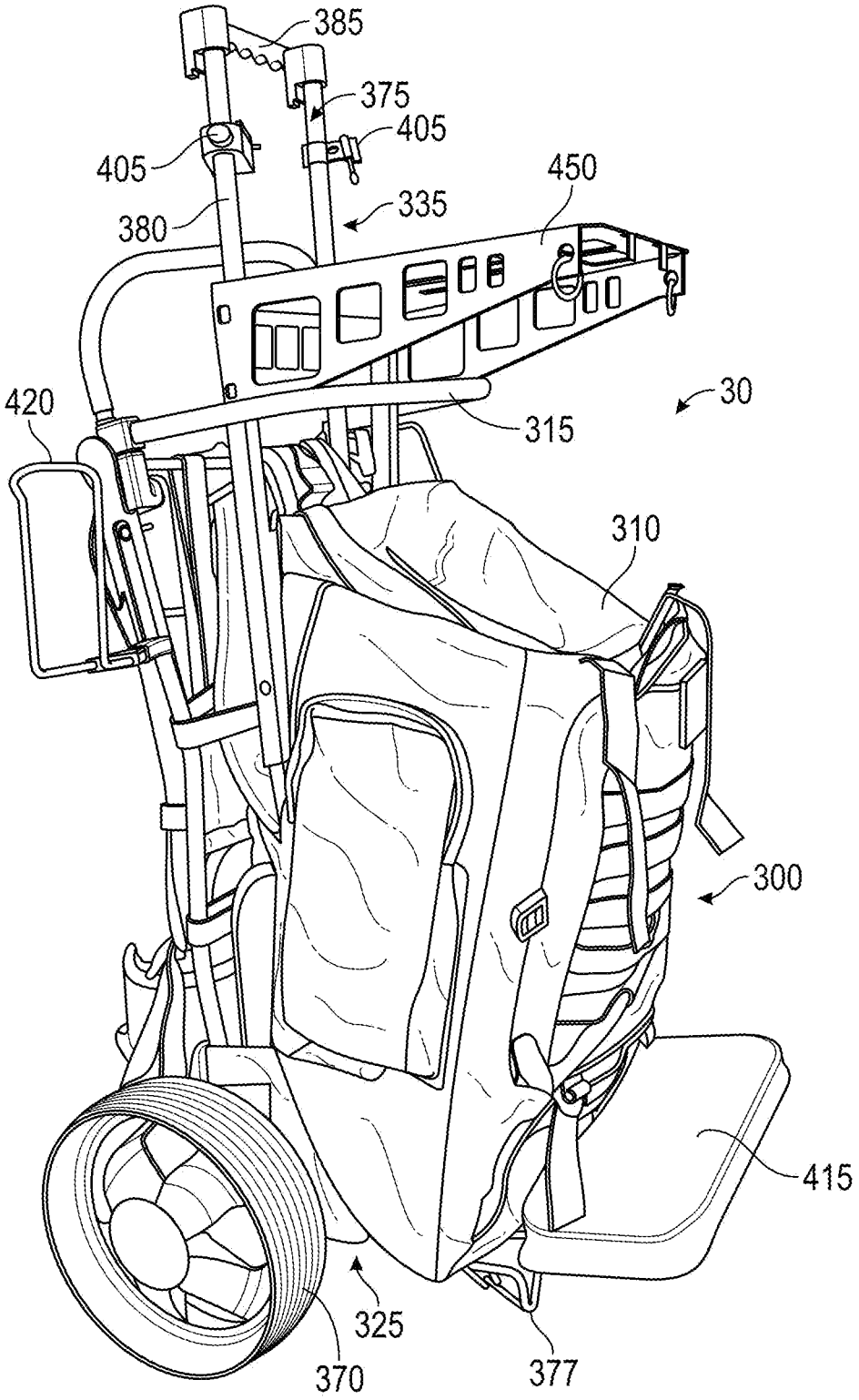
FIG. 18 illustrates a third side perspective view of a wheeled backpack of FIG. 8, with a utility tray coupled thereto, according to various examples of embodiments.
Figure 19:
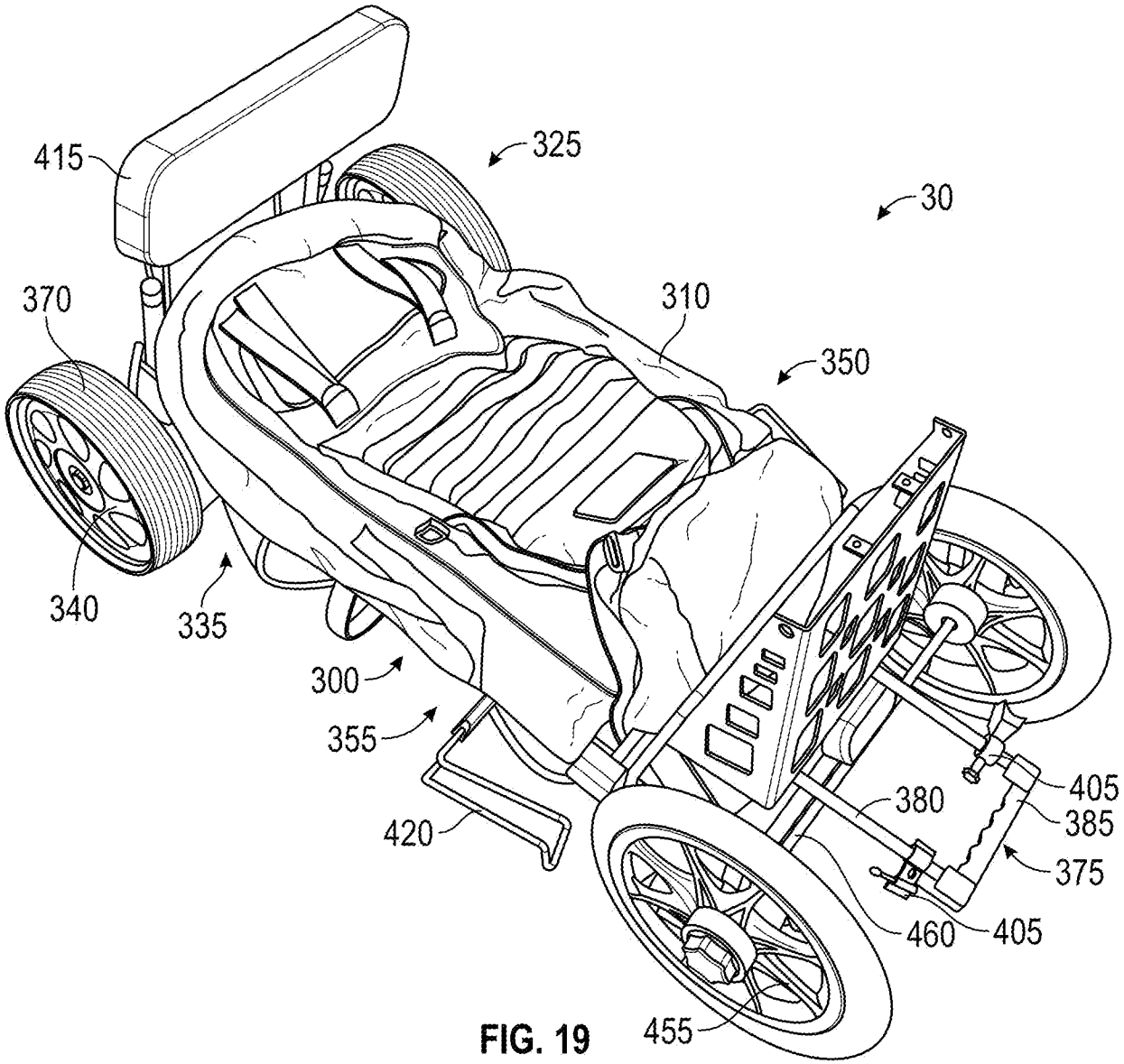
FIG. 19 illustrates a front perspective view of a wheeled backpack of FIG. 18, with a second axle and wheel assembly coupled thereto, according to various examples of embodiments.
Figure 20:
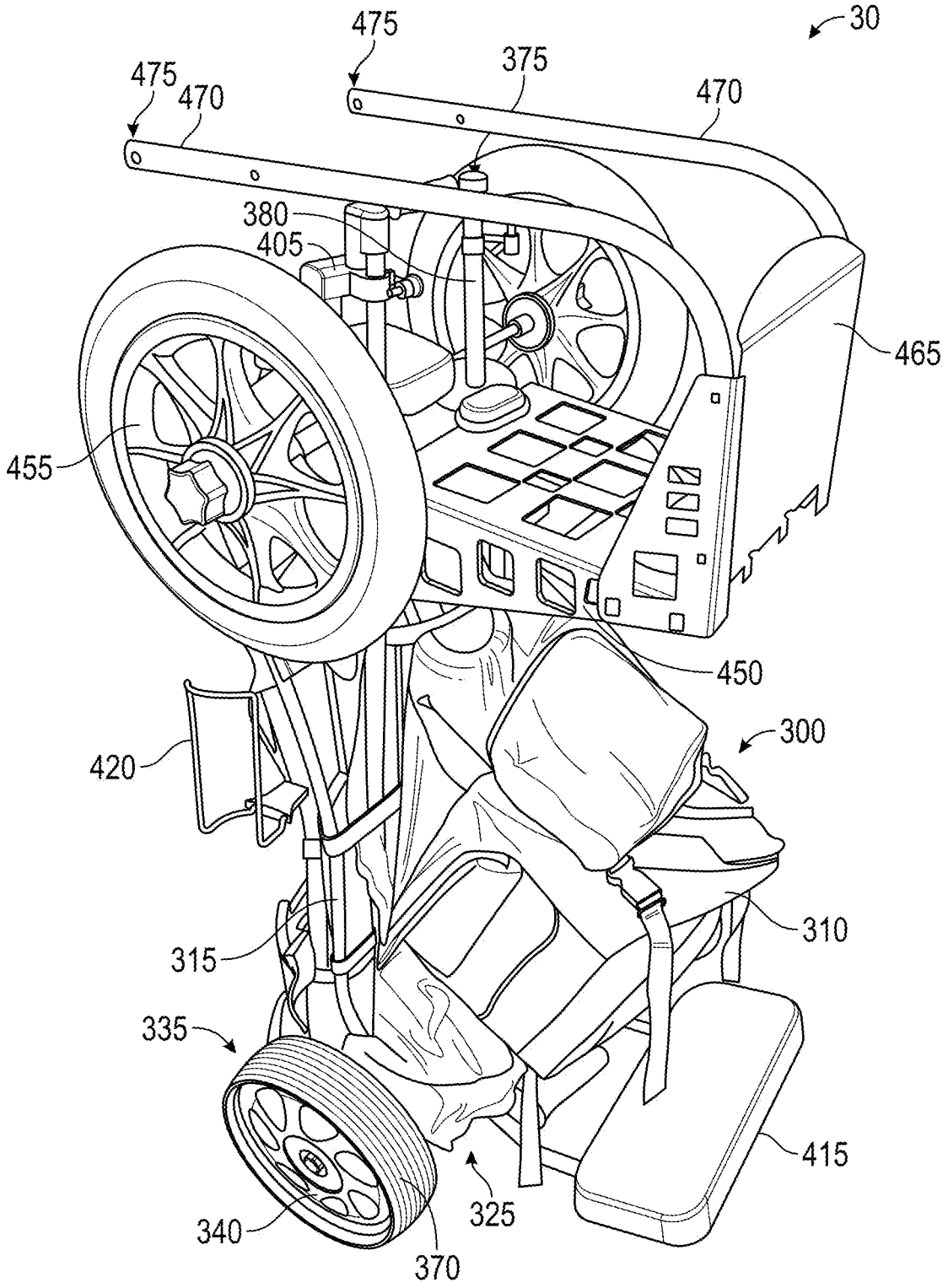
FIG. 20 illustrates a side perspective view of a wheeled backpack of FIG. 19, with a surface and support legs assembly coupled thereto, according to various examples of embodiments.

Referring now more specifically to FIGS. 18-19, in various embodiments, wheeled backpack 30 includes a utility tray 450. In various embodiments, utility tray 450 is coupled to frame 315. In various examples of embodiments, utility tray defines a number of apertures that are useable to hold various tools, etc., (e.g., a stored or opened umbrella) (including longer tools, including for example golf clubs, which may be partially retained in a compartment (such as the main compartment) of wheeled backpack 30. In that way, wheeled backpack 30 is useable as a golf pull or push cart and/or golf bag (e.g., wheeled golf bag) and/or backpack and also offers rain protection if retaining an open umbrella).

Referring now more specifically to FIG. 19, in various embodiments, the wheeled backpack 30 includes a second set of wheels 455 coupled to an axle 460 coupled or operatively coupled to frame 315. In various embodiments, frame 315 acts like a chassis. In various embodiments, axle 460 may be alternatively or additionally coupled to handle assembly 375.

In various embodiments, wheels 455 may pivot up to 360°. Wheels 455 do not have to be static axle wheels.

With wheels 340 in contact with terrain, in various embodiments, wheeled backpack 39 can be utilized as a stretcher or gurney. In various embodiments, wheeled backpack 30 may also be utilized as a walker or walking aid or stroller or infant/child carrying backpack.

With wheels 340/455 in contact with terrain, wheeled backpack 30 is useable as a vehicle (e.g., a dolly (e.g., a four wheel dolly), a wheelchair, a buggy, a rover, a gurney or stretcher, etc.). In various embodiments, wheeled backpack 30 includes one or more restraints (e.g., key ring sliders) to prevent straps from dragging or contacting terrain.

Figure 21:
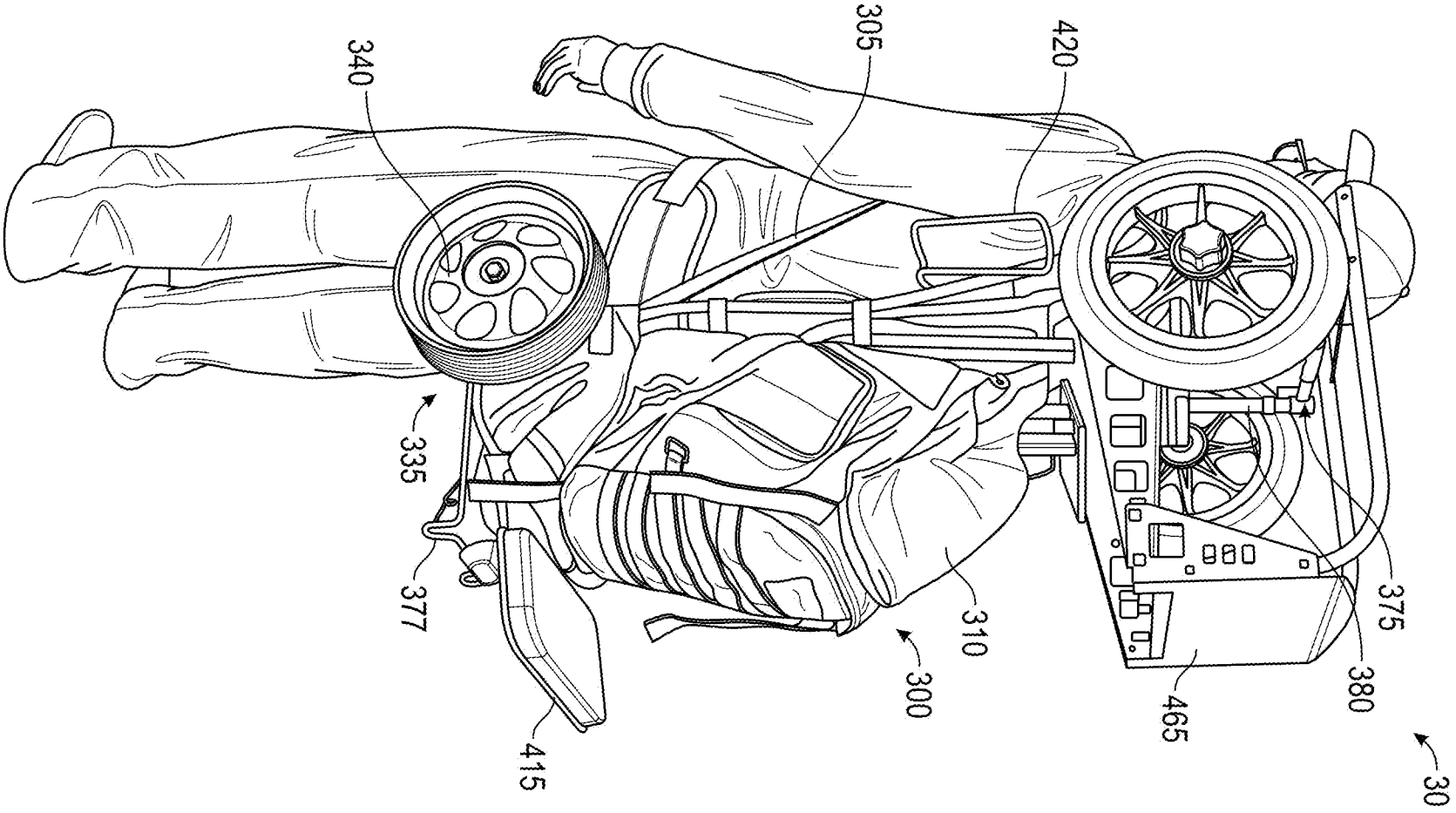
FIG. 21 illustrates a side perspective view of the wheeled backpack of FIG. 20, worn by a user of the backpack, according to various examples of embodiments.

Referring now more specifically to FIGS. 21-22, wheeled backpack 30 may also include a support or working surface 465 removably coupled to a utility tray 450. In various embodiments, utility tray 450 is coupled to one or more legs 470. When wheeled backpack 30 is utilized as a walker, legs 470 may be utilized as handles or grips for the walker. In various embodiments, the axle may be alternatively or additionally coupled to the utility tray.

The support or working surface may be used as a desk, pad, counter, etc. It may also provide protection in combat and includes or defines apertures and other features that may be used to support a weapon such as a rifle. The support or working surface may be used as a stool or seat (e.g., when all four wheels are on or near the terrain). When the support or working surface is used to support any substantial weight, the wheeled backpack may be oriented with its rear side towards the terrain such that the legs may help support the support or working surface. In various examples of embodiments, leg 470 coupled to support or working surface 465 includes a distal end 475 spaced from the terrain when wheels 455 (or tires provided thereon) are in contact with the terrain to help the wheeled move more freely but contact the terrain once weight is applied to the support or working surface. In various embodiments, a rain cover may be operatively coupled to the support or working surface.

In various embodiments, a sitting apparatus including the support or working surface, the utility tray, the legs, and the axle with wheels rotatably coupled thereto may be removed from the wheeled backpack to serve as a freestanding wheeled sitting or support surface.

In use, the wheeled backpack may be worn as a backpack with the telescoping handle extended when it is desirable to utilize tools and apparatus removably mounted or otherwise coupled thereto. When use of such tools or apparatus is not desired, the telescoping handles way be collapsed at least partially to improve comfort and/or minimize backpack footprint.

In various examples of embodiments, the wheeled assembly is not coupled or integral to the backpack, bag or luggage. For example, the wheeled assembly may be a freestanding cart configured to carry or retain a backpack, bag or luggage. In various examples of embodiments, the wheeled assembly may be retrofit to an existing backpack.

The wheeled backpack with axle and wheels may also have ball joints, struts, shocks, and springs to prevent the shock of impact from being transmitted to the body of the backpack and handle. There are other ball-in-socket steering components that could be used such as tie rods.

The wheeled backpack may also be motorized and/or self-propelled (or provide similar assistance) for the user. In addition, the wheeled backpack may include Bluetooth and/or other remote operation and control.

Given many of the disclosed features, the wheeled backpack embodiments disclosed herein may be useful for military (e.g., military in combat). It is important for combat soldiers to carry all their essential equipment to complete the mission successfully, but but not be overburdened by the load. The balance between optimal load and having essential equipment depends on the soldier's mission.

For example, a soldier anticipating a fight may carry all of his or her needs to defeat the enemy (e.g., a "fighting load") and, as such, that load is heavy but not so heavy that the soldier will be slow or weighted down. A soldier expecting to engage in ongoing direct contact with the enemy carry fighting load but also other supplies to allow the soldiers to fight and sustain themselves. This combined load is sometimes referred to as an "approach march load." An approach march load is heavy but capped at 100 pounds. It typically includes the following:

| Approach March Load | Pounds |
|---|---|
| Assault Pack | 3.1 |
| T-Shirt | 0.2 |
| Socks (2 pairs) | 0.4 |
| Wet weather top and bottom | 3.0 |
| Poncho | 1.0 |
| Poncho liner | 1.5 |

-continued

| Approach March Load | Pounds |
|---|---|
| Weapons cleaning kit | 1.0 |
| Entrenching tool with carrier | 3.5 |
| 2-quart canteens (2 each) | 10.0 |
| Meals, ready to eat (3 each stripped) | 4.2 |
| Subtotal | 27.9 |
| Add Fighting Load | 68.9 |
| Total | 96.8 pounds |

Emergency approach loads are used less frequently on ruck marches. They contain heavy items that cannot be transported by vehicle due to issues with impassable terrain. When they are used for drills, the distance travelled is often shorter than the standard twelve miles. Similarly, sustainment loads—containing equipment needed for overnight missions—are used infrequently to prepare soldiers for longer excursions.

The disclosed wheeled backpack 30 can be equipped with a small parachute to be dropped from a plane for safe landing on four wheels. It may also be remotely driven to its destination location to supply rations and ammunition, etc.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members, or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

What is claimed is:

1. A wheeled backpack comprising:

a telescoping handle assembly having a series of concentric tubes, the series of concentric tubes having an upper portion and a lower portion;

a handle coupled to the upper portion of the series of concentric tubes;

an axle coupled to the lower portion of the series of concentric tubes;

wheels rotatably coupled to each end of the axle, the wheels each having an inner side and an outer side;

the axle and series of concentric tubes being coupled to a lower portion of a backpack provided at least mostly between the inner sides of the wheels; and an external frame coupled to the backpack, the external frame having a first tubular section and a second tubular section, with the first section extended substantially parallel to the telescoping handle assembly and the second section extended substantially orthogonal to the telescoping handle assembly.

2. The wheeled backpack of claim 1, further comprising a mount coupled to the upper portion of the series of concentric tubes, with an accessory coupled to the mount.

3. The wheeled backpack of claim 2, the accessory comprising at least one of a light, a camera or other recording device including phones and smartphones, a mobile or cellular device, and a reflector.

4. The wheeled backpack of claim 1, further comprising a storage compartment coupled to the upper portion of the series of concentric tubes.

5. The wheeled backpack of claim 1, further comprising a hub cap provided on the outer side of each wheel, wherein the hub cap is removable for use as a flying disc or plate.

6. The wheeled backpack of claim 1, further comprising a plate provided below and coupled to the backpack.

7. The wheeled backpack of claim 6, further comprising a mount coupled to the plate, with an accessory coupled to the mount.

8. The wheeled backpack of claim 7, the accessory comprising at least one of a light, a camera or other recording device including phones and smartphones, a mobile or cellular device, and a reflector.

9. The wheeled backpack of claim 1, further comprising second wheels rotatably coupled to at least one of the telescoping handle assembly and the external frame.

10. The wheeled backpack of claim 1, wherein the wheels are rotatably coupled to at least one of the telescoping handle assembly and the external frame.

11. A wheeled backpack comprising:

a telescoping handle assembly having a series of concentric tubes, the series of concentric tubes having an upper portion and a lower portion;

a handle coupled to the upper portion of the series of concentric tubes;

a first axle and a rack each coupled the lower portion of the series of concentric tubes;

first wheels rotatably coupled to each end of the first axle, the first wheels each having an inner side and an outer side; and the first axle and series of concentric tubes being coupled to a lower portion of a backpack provided at least mostly between the inner sides of the first wheels; and an external frame coupled to the backpack, the external frame having an upper portion and a lower portion, with the upper portion having a first tubular section and a second tubular section, with the first section extended substantially parallel to the telescoping handle assembly and the second section extended substantially orthogonal to the telescoping handle assembly.

12. The wheeled backpack of claim 11, further comprising a backrest assembly coupled to the lower portion of the external frame.

13. The wheeled backpack of claim 11, further comprising a utility tray coupled to the upper portion of the external frame, with the utility tray defining various apertures for holding tools and equipment.

14. The wheeled backpack of claim 13, further comprising a support surface assembly having a support surface coupled to two legs, whereby the support surface is coupled to the utility tray.

15. The wheeled backpack of claim 11, further comprising a second axle coupled to the telescoping handle assembly or the upper portion of the external frame, the second axle having a second set of wheels rotatably coupled thereto.

16. The wheeled backpack of claim 15, further comprising at least one of the first wheels and second wheels are rotatably coupled to the handle.

17. The wheeled backpack of claim 11, further comprising a mount coupled to the upper portion of the series of concentric tubes, with an accessory coupled to the mount.

18. The wheeled backpack of claim 17, the accessory comprising at least one of a light, a camera or other recording devices including phones and smartphones, a mobile or cellular device, and a reflector.

19. The wheeled backpack of claim 11, further comprising a storage compartment coupled to the upper portion of the series of concentric tubes.

20. The wheeled backpack of claim 11, further comprising the first wheels rotatably coupled to at least one of the external frame and the handle.

* * * * *